US011674312B2

(12) United States Patent
Inglese

(10) Patent No.: US 11,674,312 B2
(45) Date of Patent: Jun. 13, 2023

(54) PULTRUDED FIBER REINFORCED POLYMER BUILDING SYSTEMS AND METHODS

(71) Applicant: Paul A. Inglese, Naples, FL (US)

(72) Inventor: Paul A. Inglese, Naples, FL (US)

( * ) Notice: Subject to any disclaimer, the term of this patent is extended or adjusted under 35 U.S.C. 154(b) by 115 days.

(21) Appl. No.: 17/411,041

(22) Filed: Aug. 24, 2021

(65) Prior Publication Data

US 2022/0064951 A1 Mar. 3, 2022

Related U.S. Application Data

(63) Continuation-in-part of application No. 17/093,262, filed on Nov. 9, 2020, now Pat. No. 11,613,891.

(60) Provisional application No. 63/069,972, filed on Aug. 25, 2020.

(51) Int. Cl.

| | |
|---|---|
| ***E04C 2/22*** | (2006.01) |
| ***E04B 1/41*** | (2006.01) |
| ***E04B 1/94*** | (2006.01) |
| *E04B 2/96* | (2006.01) |
| *E04B 1/38* | (2006.01) |

(52) U.S. Cl.

CPC ..... *E04C 2/22* (2013.01); *E04B 1/40* (2013.01); *E04B 1/948* (2013.01); *E04B 2/965* (2013.01); *E04B 2001/405* (2013.01); *E04B 2103/04* (2013.01)

(58) Field of Classification Search

CPC ... E04C 2/22; E04B 1/40; E04B 1/948; E04B 2/965; E04B 2001/405; E04B 2103/04; E04B 2/56; E04B 1/762; E04B 2001/7691

See application file for complete search history.

(56) References Cited

U.S. PATENT DOCUMENTS

| | | | |
|---|---|---|---|
| 3,070,845 | A | 1/1963 | Cheskin |
| 3,628,232 | A | 12/1971 | Brewer |
| 4,602,467 | A | 7/1986 | Schilger |
| 4,885,884 | A | 12/1989 | Schilger |
| 5,152,114 | A | 10/1992 | Beazley et al. |
| 6,092,340 | A | 7/2000 | Simmons |
| 6,151,858 | A | 11/2000 | Ruiz et al. |
| 6,212,849 | B1 | 4/2001 | Pellock |
| 6,314,704 | B1 | 11/2001 | Bryant |
| 6,427,403 | B1 | 8/2002 | Tambakis |

(Continued)

OTHER PUBLICATIONS

S. Bakhtiyari, et al.; "An Investigation on Fire Hazard and Smoke Toxicity of Epoxy FRP Composites"; Int. Journal on Disaster Resilience in the Built Environment, 8(3). 2017.

(Continued)

*Primary Examiner* — Beth A Stephan
(74) *Attorney, Agent, or Firm* — Steven J Shattil

(57) ABSTRACT

A composite building system comprising a structural frame, walls, floor, and roof is made of pultrusion fiber reinforced polymer (PFRP) material. A combination of PFRP, stainless steel screws and flexible epoxy can be used in the manufacture of a mobile or fixed structure. During assembly, an intumescent fire barrier can be applied to the PFRP components. Unlike traditional building materials, an exterior waterproof finish coating is not required when using a PFRP wall, floor, and roof assembly. The PFRP wall and wall assembly can be used with both PFRP structural framing and traditional framing materials, such as concrete, steel, or wood, allowing the PFRP wall and wall assembly to be used as a mid-rise or high-rise curtain wall.

10 Claims, 21 Drawing Sheets

(56) References Cited

U.S. PATENT DOCUMENTS

| | | | |
|---|---|---|---|
| 7,690,167 | B2 | 4/2010 | Antonic |
| 7,694,483 | B1 | 4/2010 | Tucker |
| 7,856,778 | B2 | 12/2010 | Pantelides et al. |
| 7,926,241 | B2 | 4/2011 | Schiffmann et al. |
| 7,980,033 | B1 | 7/2011 | Fyfe |
| 7,992,352 | B2 | 8/2011 | Bonds et al. |
| 8,266,867 | B2 | 9/2012 | Schiffmann et al. |
| 8,534,028 | B2 | 9/2013 | Wojtusik et al. |
| 8,601,763 | B2 | 12/2013 | Bui |
| 8,696,048 | B2 | 4/2014 | Griffin et al. |
| 9,493,938 | B2 | 11/2016 | Schiffmann et al. |
| 10,138,632 | B2 | 11/2018 | Mirmiran et al. |
| 11,299,886 | B2 | 4/2022 | El-Domiaty et al. |
| 2005/0076805 | A1 | 4/2005 | Creighton et al. |
| 2006/0254167 | A1 | 11/2006 | Antonic |
| 2007/0094992 | A1 | 5/2007 | Antonic |
| 2007/0216197 | A1 | 9/2007 | Wuerfel |
| 2008/0127584 | A1 | 6/2008 | Schiffmann et al. |
| 2011/0204611 | A1 | 8/2011 | Ziegler et al. |
| 2016/0241007 | A1 | 8/2016 | Tremaine et al. |
| 2016/0340904 | A1 | 11/2016 | Mirmiran et al. |
| 2017/0138044 | A1 | 5/2017 | Malakauskas et al. |
| 2017/0241134 | A1 | 8/2017 | McCloud et al. |
| 2019/0283372 | A1 | 9/2019 | Zhao et al. |
| 2019/0301154 | A1 | 10/2019 | McCloud et al. |
| 2020/0010121 | A1 | 1/2020 | Swayne et al. |
| 2020/0240097 | A1 | 7/2020 | Rosemont |
| 2021/0087694 | A1 | 3/2021 | Rack |
| 2021/0115675 | A1 | 4/2021 | Mol et al. |

OTHER PUBLICATIONS

S. Black; "International Building Code: Meeting requirements for interior composites"; https://www.compositesworld.com/articles/international-building-code-meeting-requirements-for-interior-composites; Nov. 30, 2010.

J.P. Busel, "Fiber Reinforced Polymer (FRP) ACI Guidelines and Field Installations"; National Concrete Consortium, Apr. 25, 2018.

R. Liang and G. Hota; "Advanced Fiber Reinforced Polymer Composites for Corrosion Mitigation in Water Infrastructure"; The 4th Biennial TRB-CMTS Conference: From Sail to Satellite: Delivering Solutions for Tomorrow's Marine Transportation Systems Conference, Jun. 21-23, 2016.

J.C. Miguel et al., "Fiber Reinforced Polymer (FRP): A New Materia Used in Facades of Tall Buildings"; Global Interchanges: Resurgence of the Skyscraper City, 2015.

American Composites Manufacturers Association; "Guidelines and Recommended Practices for Fiber-Reinforced-Polymer (FRP) Architectural Products"; 2016.

S. Witt and G. Gilda; "Structural Rehabilitation"; American Composites Manufacturers Association, Structure Magazine, Mar. 2016.

Strongwell, "FRP Specifications"; Section 06 70 00, Fiberglass Reinforced Polymer (FRP); Nov. 2016.

Gangarao and Liang; "Applications of Fiber Reinforced Polymer Composites"; ICERP 2006, Chennai, India, Feb. 23-25, 2006.

PCT International Search Report, for PCT/US21/47414, our reference PI001PCT, dated Feb. 4, 2022.

PCT Written Opinion, for PCT/US21/47414, our reference PI001PCT, dated Feb. 4, 2022.

PULTRUDED FIBER REINFORCED POLYMER BUILDING SYSTEMS AND METHODS

CROSS REFERENCE TO PRIOR APPLICATIONS

This application is a Continuation in Part of U.S. patent application Ser. No. 17/093,262, filed on Nov. 9, 2020, which claims the priority benefit of U.S. Provisional Patent Application Ser. No. 63/069,972, filed on Aug. 25, 2020, which are expressly incorporated by reference herein in their entireties.

FIELD

Aspects of the disclosure generally relate to building systems, structures, and components; and more particularly to methods and apparatuses for composite building systems, vehicles, structural frames, walls, floors, roofs, and exterior cladding comprising Pultruded Fiberglass Reinforced Polymer (PFRP) material.

BACKGROUND

The background description includes information that may be useful in understanding the present inventive subject matter. It is not an admission that any of the information provided herein is prior art or relevant to the presently claimed inventive subject matter, or that any publication, specifically or implicitly referenced, is prior art.

Pultruded Fiber Reinforced Polymer (PFRP) can include fiberglass, which is a composite comprising a polymer resin matrix reinforced with embedded glass fibers. The strength of a fiberglass element is determined primarily by the type, orientation, quantity, and location of the glass fibers within the composite. This allows the product to be engineered to provide specific performance characteristics such as structural flexibility or stiffness.

Pultrusion is a manufacturing process for producing continuous lengths of PFRP structural shapes with constant cross-sections. Raw materials can include a liquid resin mixture (containing resin, fillers, and specialized additives) and flexible textile reinforcing fibers, such as glass, carbon, and synthetic fibers.

The process involves pulling these raw materials (rather than pushing, as is the case in extrusion) through a heated steel die using a continuous pulling device. This technique removes all air/gasses from the product, allowing for a much stronger and safer product compared with other fiberglass manufacturing methods. In addition, this process allows PFRP materials to be energy efficient while having the lowest embodied carbon footprint compared to traditional construction materials, such as steel and concrete. This enables PFRP materials to meet current and future energy-efficiency code requirements as well as meeting LEED (Leadership in Energy and Environmental Design) and Net Zero environmental impact sustainability certification.

Pultrusion yields smooth finished parts that typically do not require post processing. A wide range of continuous, consistent, solid, and hollow profiles allow for many repetitive uses or can be custom-made to fit specific design applications. The pultrusion process using glass fiber and polyester resins have been used for decades. In the last 10 years, PFRP has gained in popularity with many market segments taking advantage of the many useful benefits that advanced composites offer. However, there are numerous barriers to entry that prohibit these market segments from using PFRP materials to construct an entire structure used for human occupancy.

Today, almost all mobile and fixed building structures or enclosures are still constructed using traditional building materials, such as steel, concrete, and wood. For any new building material to be certified for human occupancy, an engineering process and digital model would need to be developed. Success would result in a new building system and method that solves long-standing construction problems which are inherent to traditional building materials while meeting or surpassing mandated building codes and engineering standards that apply to varying geographical locations. Currently, there are no building systems or engineering models using only PFRP materials that account for deflection, uplift, loads, sheer and racking, which is needed to develop a complete building structure, certified for human occupancy.

Barriers to entry for using new building materials include fire protection, heating, air conditioning, ventilation standards, exterior heat gain by solar radiation, internal thermal efficiency, engineering and architectural design, and a lack of desire to change long-standing building practices.

Aspects disclosed herein are novel, non-obvious and solve the problems that have prevented the use of PFRP materials in making a complete building structure within the current construction industry.

SUMMARY

Disclosed aspects include composite building and mobile systems that exploit advantageous characteristics of PFRP materials and eliminate many long-standing problems found within the construction industry using concrete, steel, and wood. PFRPs can weigh approximately 75% less than steel and 30% less than aluminum. Disclosed aspects can lower transportation costs, provide easier installation, and weighs less for more efficient structural design; reduction of foundation size requirements, less equipment, fewer workers, and less time to install. PFRP's can be prefabricated within a manufacturing facility using precision automated machinery or fabricated in the field using standard carpentry tools. In addition, PFRP's are stronger than steel, on a pound for pound comparison, and do not retain its memory during a bending action.

These benefits can greatly reduce building costs, installation time, equipment, and labor costs. PFRPs are corrosion-resistant, will not rot, and can withstand weathering and intense use. PFRPs are impervious to insects and a broad range of corrosive environments. Maintenance costs, such as routine painting, repair, or replacement, can be reduced or eliminated. PFRPs have low thermal conductivity, are electrically non-conductive (making the material an excellent insulator) and are transparent to radio frequencies, microwaves, and other electromagnetic signals.

In one aspect, a composite building system comprising a structural frame, walls, floor, and roof made of PFRP material can be used to construct mobile and fixed building structures, enclosures, or vehicles. Disclosed aspects can be developed for occupied structures within the residential, commercial, industrial, healthcare, aerospace, government defense, energy, and agriculture sectors, as well as other markets.

PFRP structures can be designed to provide variable strength for regions conducive to high-velocity winds or seismic activity. Disclosed aspects can provide for reduced maintenance requirements and costs, thereby, reducing the total cost of ownership over the life of the structure, while enhancing safety and protection for persons or property.

A PFRP wall-panel frame assembly is a fully composite system comprising a plurality of vertical PFRP studs and horizontal PFRP braces, attaching together using small PFRP clip angle brackets at the top PFRP head track and bottom PFRP sill track. A PFRP ballistic or non-ballistic sheathing is applied to the PFRP frame assembly using a plurality of stainless-steel screws and flexible epoxy bond configured to provide waterproofing and a uniform coefficient of thermal expansion throughout the PFRP wall-panel frame assembly.

A PFRP embed connector is configured for connecting a PFRP wall-panel frame assembly directly to a concrete panel, such as an architectural precast concrete panel or a concrete tilt-wall, without using an air gap or insulation strip to mitigate thermal bridging. The PFRP embed connector comprises of a PFRP threaded shaft, a PFRP fixed nut, and a PFRP variable nut; wherein the PFRP variable nut connects the PFRP embed connector to the PFRP frame assembly and the PFRP fixed nut is configured to hold the PFRP frame assembly off the casting surface at the height needed to ensure uniform alignment of the exterior concrete panel face with the uniform alignment of the interior PFRP frame assembly.

A PFRP structural frame assembly comprises of a plurality of vertical PFRP columns using either a vertical PFRP I-beam column or vertical PFRP wide flange column, attaching to a plurality of horizontal PFRP beams, using either a horizontal PFRP I-beam or a horizontal PFRP wide flange beam with large PFRP clip angle brackets.

A PFRP roof assembly comprises of a plurality of PFRP trusses or joists using either a horizontal PFRP C channel, L channel or a hollow tube attaching to a horizontal PFRP I-beam or a horizontal PFRP wide flange beam using small PFRP clip angle brackets which configures the PFRP roof assembly to support the PFRP roof sheathing.

A PFRP floor assembly comprises of a plurality of PFRP trusses or joists using either a horizontal PFRP C channel or L channel, or a hollow tube attaching to a horizontal PFRP I-beam, or a horizontal PFRP wide flange beam using PFRP clip angle brackets which configures the PFRP floor assembly to support PFRP floor sheathing.

A PFRP structural building assembly that comprises of a PFRP floor assembly, which has a top surface of PFRP ballistic or non-ballistic sheathing or PFRP hollow core plank or PFRP solid core plank, a bottom surface of a PFRP ballistic or non-ballistic sheathing or PFRP hollow core plank or PFRP solid core plank, and a PFRP ballistic or non-ballistic sheathing or PFRP hollow core plank or PFRP solid core plank, surrounding the top surface and the bottom surface to comprise a fully enclosed hollow PFRP floor assembly which attaches to a PFRP flange connected to the PFRP floor assembly and extending in an outward direction from the PFRP floor assembly, thereby, a PFRP flange is configured to encircle a vertical PFRP piling and move axially along the vertical PFRP piling.

The disclosed aspect comprises of a solar panel or solar tile connecting to a PFRP mounting bracket which is connected to a PFRP Z bracket allowing the solar panel or solar tile configured to mount the solar panel or solar tile directly on a roof, wherein PFRP Z bracket provides for elevating the solar panel or solar tile 3¾" inches above the roof to allow airflow to occur under the solar panel or solar tile, thereby, improving the solar panel's power generation efficiency.

Groupings of alternative elements or aspect of the disclosed subject matter herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified, thus fulfilling the written description of all Markush groups used in the appended claims.

All methods described herein can be performed in any suitable order unless otherwise indicated herein or otherwise clearly contradicted by context.

The use of all examples, or exemplary language (e.g., "such as") provided with respect to certain aspect herein is intended merely to better illuminate the inventive subject matter and does not pose a limitation on the scope of the inventive subject matter otherwise claimed. No language in the specification should be construed as indicating any non-claimed element as essential to the practice of the inventive subject matter.

BRIEF DESCRIPTION OF THE DRAWINGS

The disclosed aspects will hereinafter be described in conjunction with the appended drawings, provided to illustrate and not to limit the disclosed aspects, wherein like designations denote like elements.

DETAILED DESCRIPTION

Figure 1:
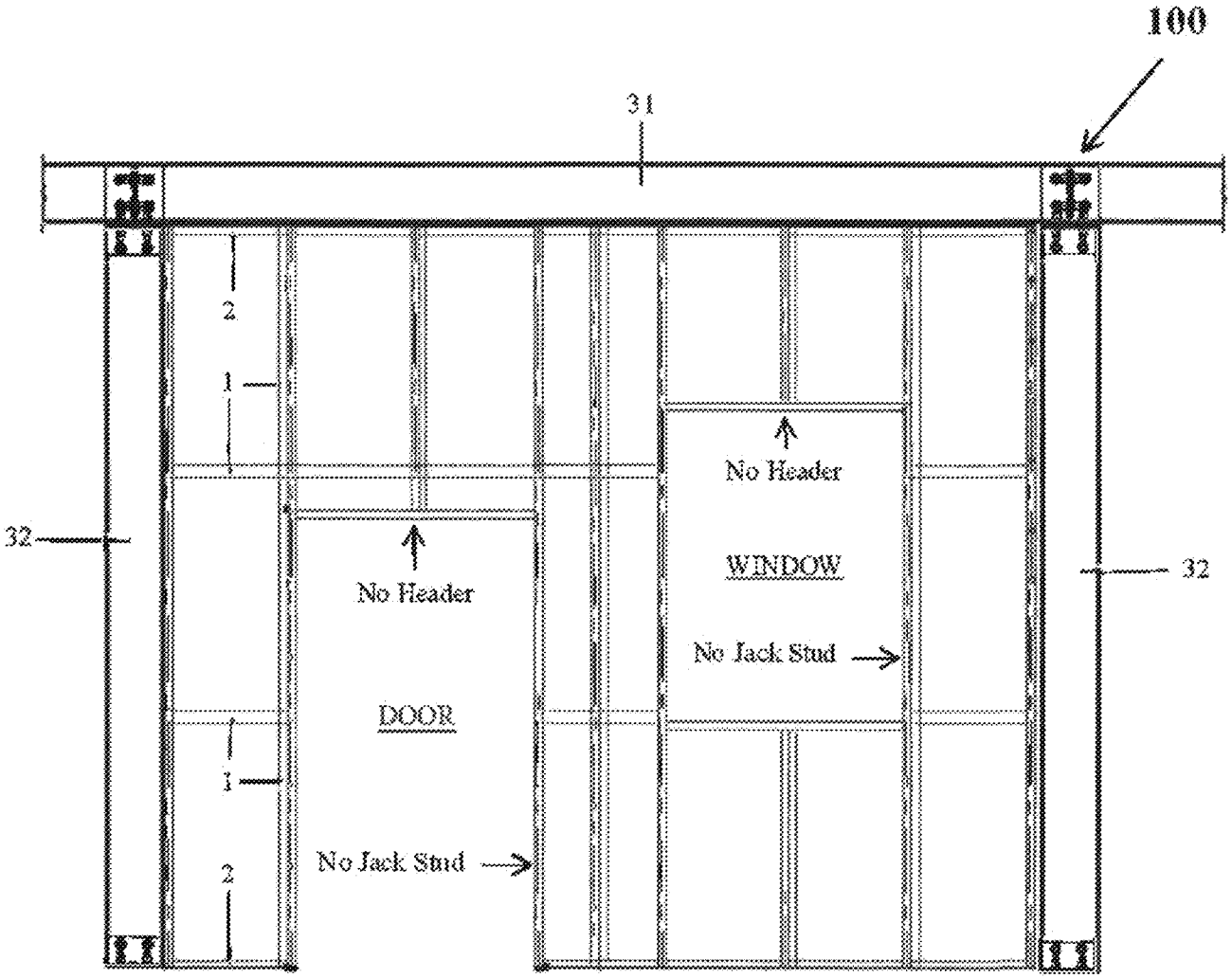
FIG. 1 is a schematic representation of a PFRP non-load bearing wall frame assembly

The description that follows includes exemplary systems, methods, and techniques that embody techniques of this disclosure. However, it is understood that the described aspects may be practiced without these specific details.

Apparatuses and methods are described in the following description and illustrated in the accompanying drawings by various blocks, modules, components, steps, parts, processes, etc. (collectively referred to as "elements").

PART NUMBERS

1—PFRP C channel vertical stud and horizontal brace
2—PFRP C channel upper head or lower sill track
3—PFRP hold down bracket
4—PFRP sheathing such as ballistic or non-ballistic sheathing
5—PFRP clip angle bracket
6—Backer Rod & Caulk
7—Stainless steel self-drilling screw
11—PFRP flat tip embed connector
12—PFRP pointed tip embed connector
13—PFRP frame assembly
14—Air gap
15—Architectural precast concrete cladding
16—PFRP variable connector nut
17—PFRP fix nut
18—Insulation
19—PFRP threaded shaft
20—PFRP pitch roof
21—PFRP flat roof
22—PFRP wall assembly
23—Traditional bolt
24—PFRP C channel, I-beam, wide flange beam, joists, rafters
25—PFRP floor assembly
26—PFRP roof/floor decking, hollow core planks, solid plank
27—Concrete footer
28—Flexible epoxy adhesive
29—PFRP flange
30—PFRP piling
31—PFRP I-beam or wide flange beam used horizontally as a structural beam
32—PFRP I-beam or wide flange beam used vertically as a structural column
33—PFRP Z Bracket
34—PFRP solar mounting bracket
35—PFRP C or L Channel or hallow tube truss
36—Standard metal, slotted bi-directional drift connector L bracket
37—Standard metal, slotted bi-directional drift connector Cross bracket
38—Concrete or steel flooring support for mid and high-rise structures
39—PFRP curtain wall
40—Exterior cladding

100—PFRP wall frame assembly.

200—PFRP embed connectors.

300—PFRP roof assembly.

400—PFRP floor assembly.

500—PFRP single or multi-story building system attached to concrete footer.

600—PFRP single or multi-story building system attached to a PFRP piling with PFRP flange.

700—PFRP I-beam or wide flange structural frame assembly.

800—PFRP solar roof tile and solar roof panel assembly.

900—PFRP truss roof or floor assembly.

1000—PFRP curtain wall and exterior cladding assembly.

Glossary

As used herein and in the claims, each of the terms defined in this glossary is understood to have the meaning set forth in this glossary. As such, claims should first be construed based on intrinsic. evidence. If a claim term remains ambiguous after considering the intrinsic evidence, then extrinsic evidence is to be considered.

Architectural Precast Concrete Cladding—Precast concrete cladding offers a cost-effective means of providing a robust, high-quality facade, with a great variety of durable textures, colors, and patterns, including a range of facing materials such as stone and brick.

Ballistic—is the field of mechanics concerned with the launching, flight behavior and impact effects of projectiles, especially ranged weapon munitions such as bullets.

Coefficient of Thermal Transfer—The heat transfer of coefficient is the reciprocal of thermal insulation. This is used for building materials (R-Value) and is a measure of the overall ability of a series of conductive and convective barriers to transfer heat.

Composite Material—is a material made from two or more constituent materials with significantly different physical or chemical properties that, when combined, produce a material with characteristics different from the individual components.

Curtain Wall—An outer covering of a building in which the outer walls are not structural, utilized only to keep the weather out and occupants in.

Deteriorate—to make or become worse or inferior in character, quality, value; to disintegrate or wear away.

Embed—to fix into a surrounding mass; to surround tightly or firmly; envelop or enclose; to incorporate or contain as an essential part or characteristic.

Exterior Cladding—The outermost layer of covering on buildings. All exterior surfaces including walls, windows, doors, soffits, and trim. Also known as wall covering.

Fiberglass—is a common type of fiber-reinforced plastic using glass fiber. The fibers may be randomly arranged, flattened into a sheet, or woven into a fabric. The plastic matrix may be a thermoset polymer matrix, most often based on thermosetting polymers such as epoxy, polyester resin, or vinyl ester, or a thermoplastic.

Fiber Reinforced Polymer (FRP) —most often referred to as "fiberglass". Used in this context, "fiberglass" is a composite consisting of a polymer resin matrix reinforced by embedded glass fibers.

Flexible Epoxy—An adhesive that is not brittle and offers some degree of elasticity and flexibility. This makes it less likely to suffer from cracks or damage when exposed to extreme temperatures, unexpected forces, or sharp impacts.

Intumescent—is a substance that swells because of heat exposure, thus leading to an increase in volume and decrease in density. Intumescents are typically used in passive fire protection and require listing, approval, and compliance in their installed configurations to comply with the national building codes and laws.

Outgassing—is the release of a gas that was dissolved, trapped, frozen, or absorbed in some material. Outgassing can include sublimation and evaporation, as well as desorption, seepage from cracks or internal volumes, and gaseous products of slow chemical reactions.

PFRP—a continuous molding process using material consisting of strong fibers embedded in a resin matrix. The most common fibers are glass, carbon, and synthetic fibers which are formed using a pultrusion method which eliminates out-gassing while providing a method to strengthen the product.

Polymer—is a substance or material consisting of very large molecules, or macromolecules, composed of many repeating subunits. Polymer can be both synthetic and natural.

Pultrusion—is a continuous process for manufacture of composite materials with constant cross-section. The term is a portmanteau word, combining "pull" and "extrusion". As opposed to extrusion, which pushes the material, pultrusion works by pulling the material.

Resin—is a generic term used to designate the polymer, polymer precursor material, and/or mixture or formulation thereof with various additives or chemically reactive components.

Seismic—pertaining to, of the nature of, or caused by an earthquake or vibration of the earth, whether due to natural or artificial causes.

Thermal Air Gap—The deliberate spacing (generally ¾ inch) between a frame assembly and an architectural concrete cladding to minimize the thermal transfer from solar heating between the two components.

DETAILED DESCRIPTION

Figure 14:
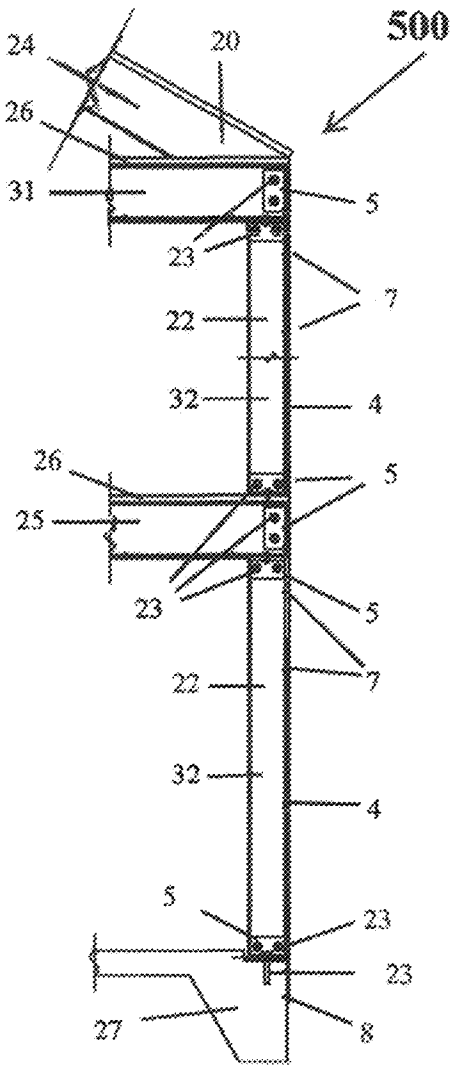
FIG. 14 is a schematic representation of the components and function of a PFRP roof, wall and floor assembly for a multi-story structure connected to a traditional concrete footing

The unique flexibility of the PFRP frame assembly 13 of system 100 shown in FIG. 1 can enable the PFRP wall assembly 22 of system 500 FIG. 14, to be used in a multi-story or single-story structure.

Figure 10:
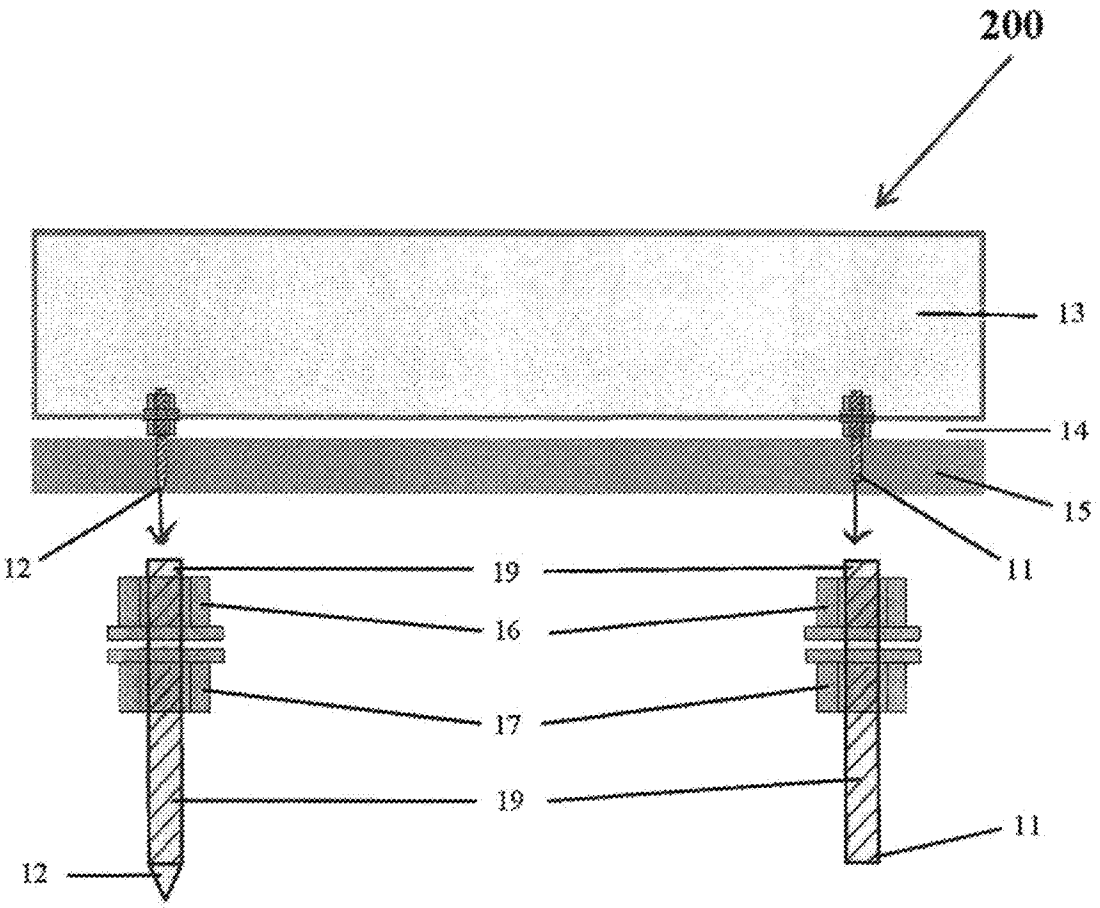
FIG. 10 is a schematic representation of the components and function of a PFRP flat tip and pointed tip embed connector to connect an exterior architecture concrete cladding to a PFRP wall frame assembly
Figures 21A, 21B, 21C:
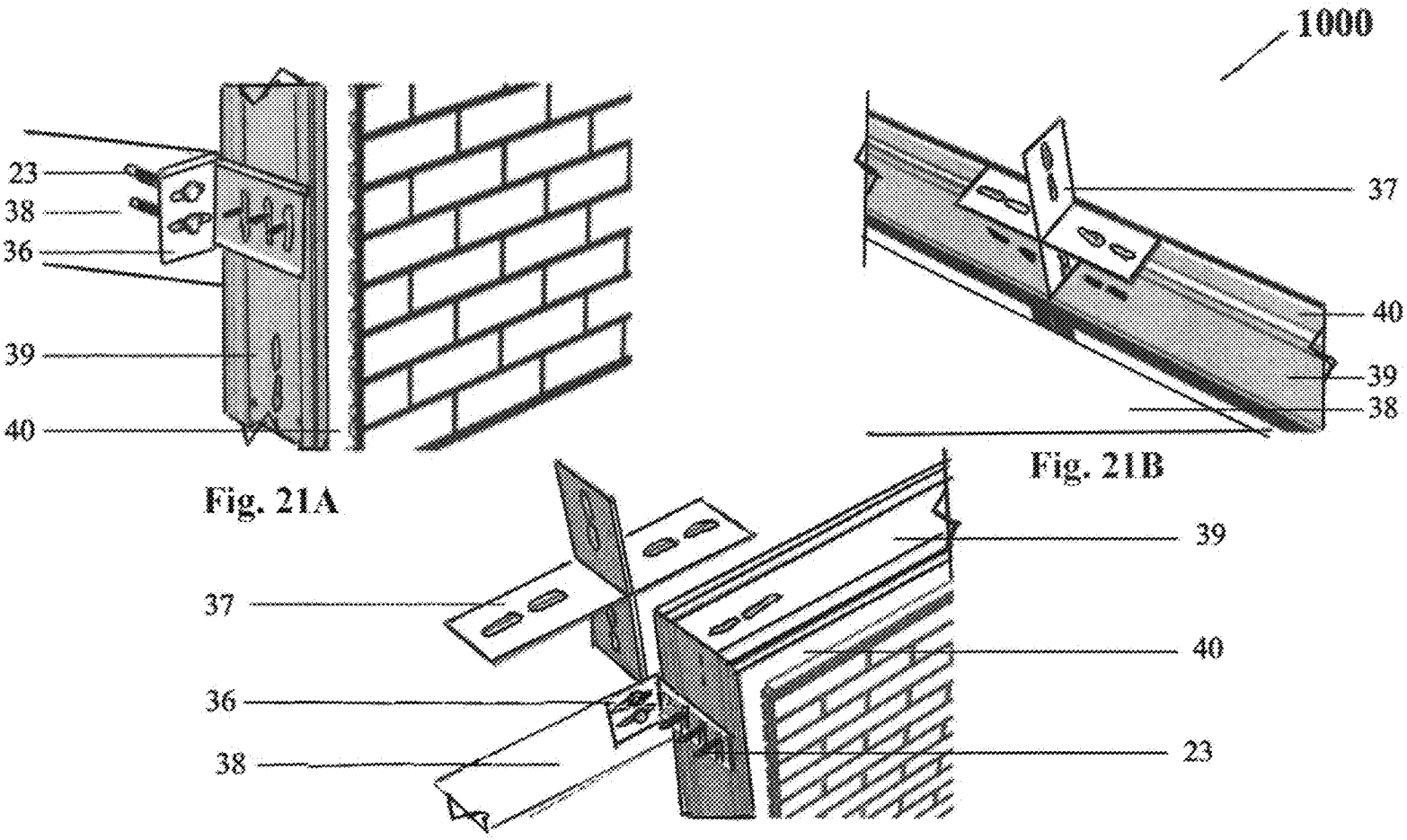
FIG. 21A is a schematic representation of the components and function of a PFRP frame assembly being used as a curtain wall or exterior cladding applied to mid-rise and high-rise building structures using slotted, bi-directional, L bracket for uniform spacing from the building frame assembly
FIG. 21B is a schematic representation of the components and function of a PFRP frame assembly being used as a curtain wall or exterior cladding when connecting additional PFRP frame assemblies applied to mid-rise and high-rise building structures using slotted, bi-directional, Cross brackets for uniform spacing of the PFRP frame assemblies
FIG. 21C is a schematic representation of the components and function of a PFRP frame assembly being used as a curtain wall or exterior cladding when connecting a plurality of PFRP frame assemblies applied to mid-rise or high-rise building structures using a combination of L and Cross slotted, bi-directional, brackets to produce a uniform alignment of all PFRP frame assemblies attached to the exterior of the building structure

In one aspect of the invention, the PFRP frame assembly 13 can be used as an architectural precast concrete cladding panel, such as panel 15 of system 200 shown in FIG. 10, where the PFRP frame 13 is configured to support the weight of a concrete panel with the use of PFRP embed connectors 11 or 12, FIG. 10. The PFRP wall assembly 22 of system 1000 shown in FIGS. 21A, 21B & 21C can also be used as a PFRP curtain wall 39 or exterior cladding 40 commonly used for mid-rise and high-rise structures. In either configuration, bi-directional metal drift connectors 36 and 37 can use metal bolts 23 to anchor the curtain wall 39 to a concrete or steel flooring support 38. Once the curtain wall 39 is anchored to the mid-rise or high-rise structure, the horizontal and vertical slots on the Bi-directional drift connectors 36 and 37 enable the PFRP frame assembly 13 or PFRP wall assembly 22 to be moved in a horizontal or vertical direction on the exterior frame of the structure, such as to ensure the proper alignment of the facing between multiple PFRP frame assemblies 13 or PFRP wall assemblies 22.

Figure 6:
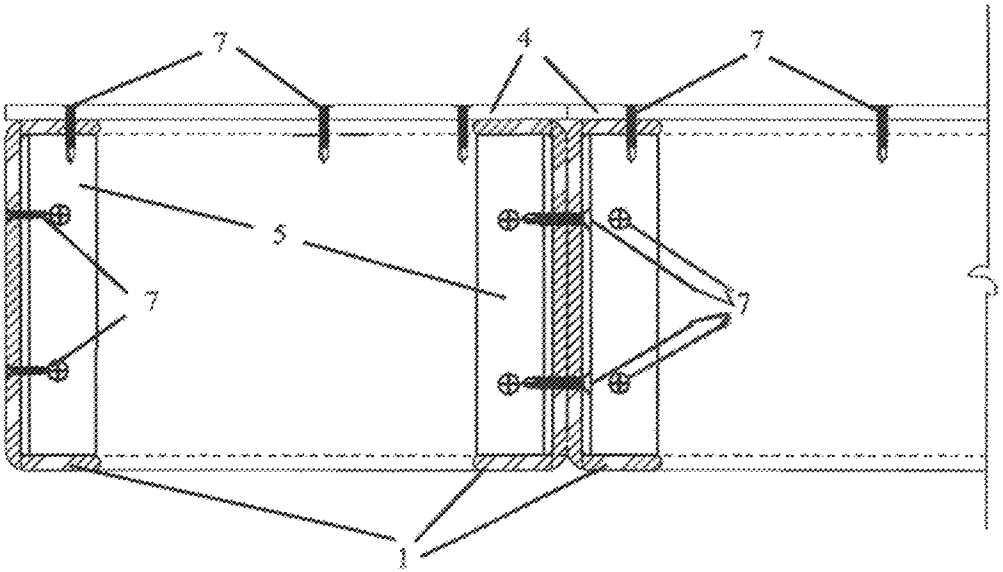
FIG. 6 is a schematic representation of the components and function of a vertical PFRP double C channel stud connected to horizontal PFRP C channel stud or PFRP C channel head or sill track
Figure 7:
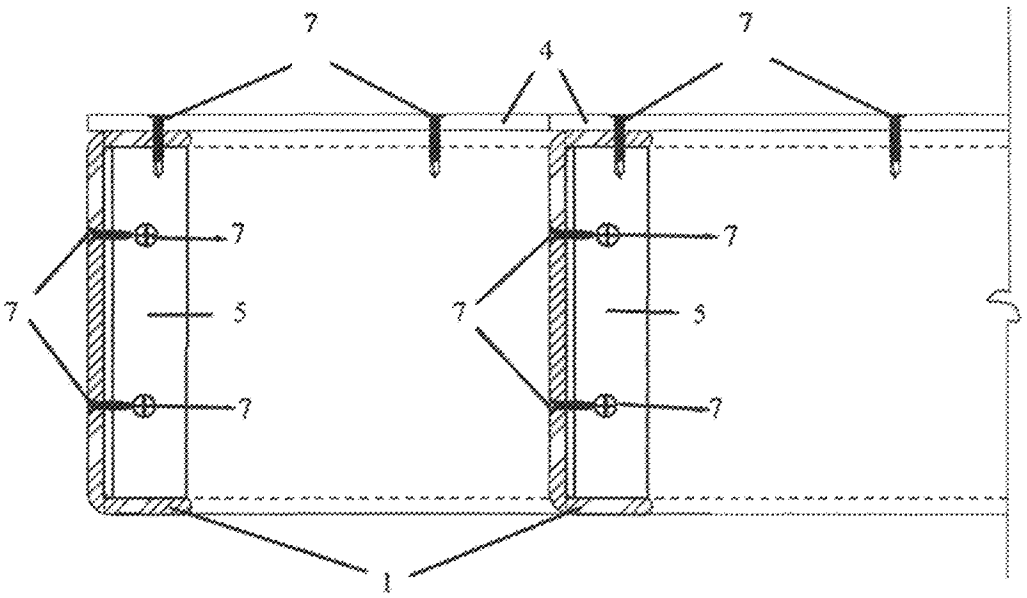
FIG. 7 is a schematic representation of the components and function of a vertical PFRP single C channel stud connected to horizontal PFRP C channel stud or PFRP C channel head or sill track at the end of an PFRP wall frame assembly
Figure 8B:
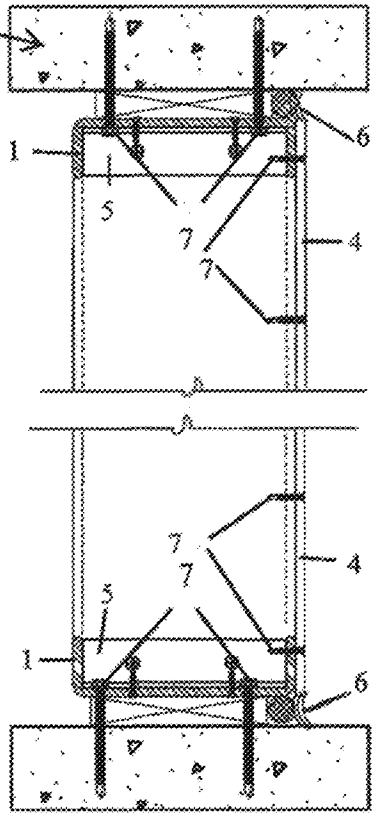
FIG. 8B is a schematic representation of an PFRP wall assembly connecting to a concrete building structure using a small PFRP clip angle bracket and stainless-steel screws
Figure 8A:
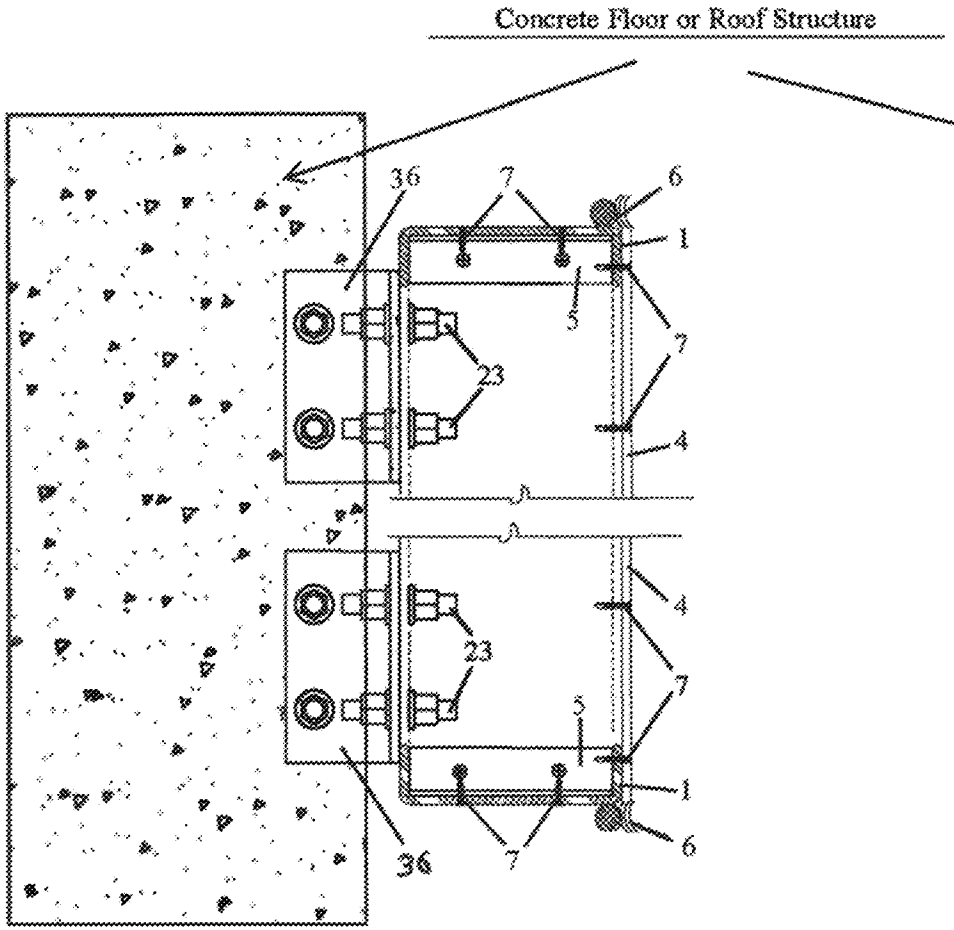
FIG. 8A is a schematic representation of an PFRP wall assembly connecting to a concrete building structure using large PFRP clip angle brackets and steel bolts
Figures 9A, 9B:
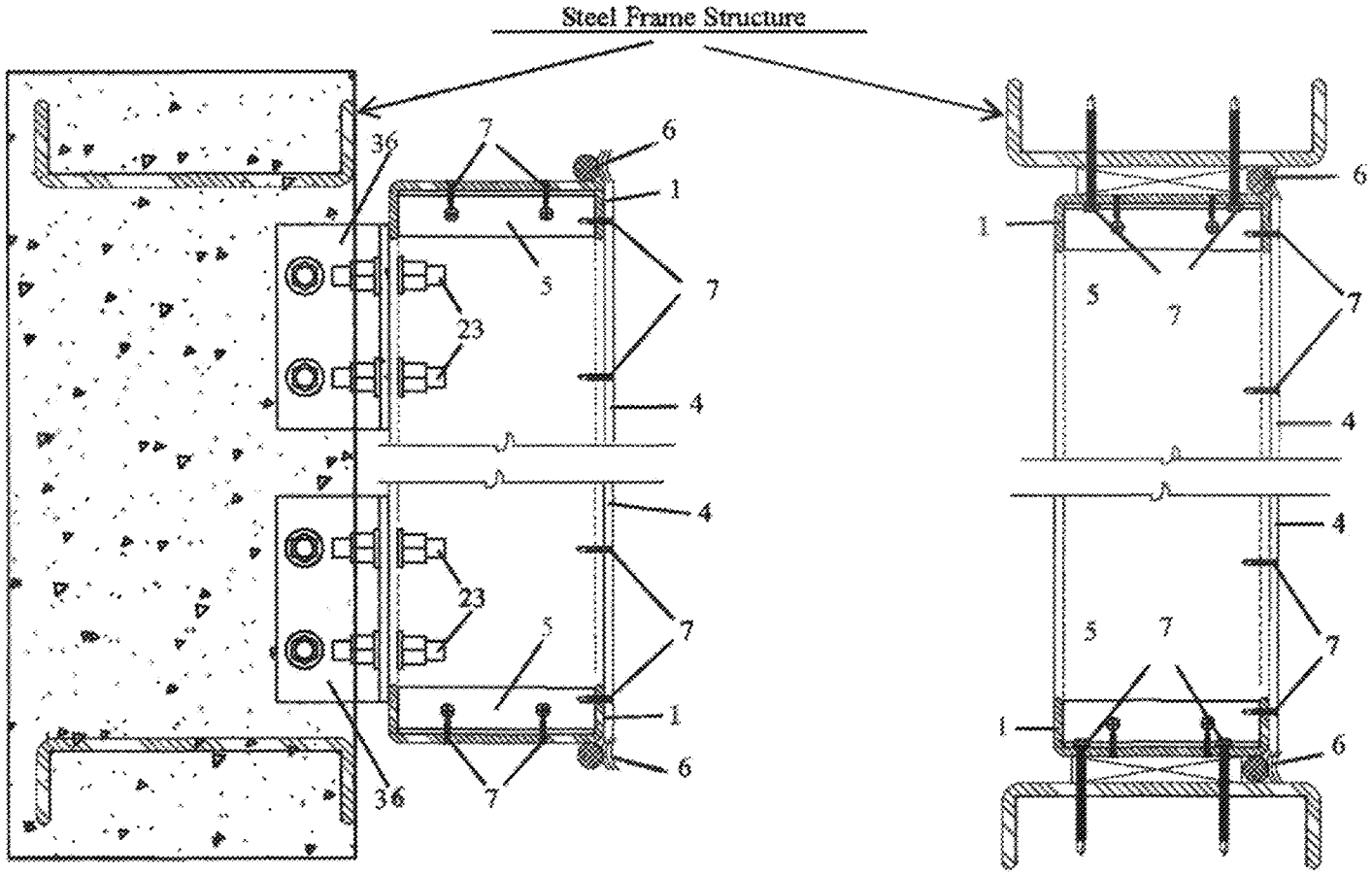
FIG. 9A is a schematic representation of an PFRP wall assembly connecting to a steel building structure using large PFRP clip angle brackets and steel bolts
FIG. 9B is a schematic representation of an PFRP wall assembly connecting to a steel building structure using a small PFRP clip angle brackets and stainless-steel screws

The PFRP frame assembly, 13, can be constructed using single PFRP studs to create a non-load bearing PFRP wall, FIG. 7, or double PFRP studs, FIG. 6, to create a load bearing PFRP wall. Adding or subtracting PFRP studs to the PFRP frame assembly, 13, controls the amount of deflection within the PFRP frame assembly to meet engineering requirements for local building codes. Unlike hybrid frame assemblies that use wood or steel structural components, the PFRP frame assembly 13 is a fully composite system, which avoids corrosion and is resistant to mold, termites, water, moisture, and chemicals. In one aspect, frame assembly 13 can be an insulated frame assembly that is configured to mitigate thermal bridging. Specifically, all the structural elements, such as studs, in the assembly can be comprised of materials that enhance thermal isolation. For example, PFRP studs can be used instead of metal studs to provide high energy efficiency. and eliminates noise vibration which is also commonly found in metal framing.

Figure 3A:
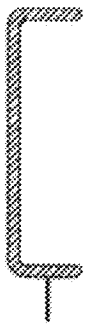
FIG. 3A is a schematic representation of a vertical PFRP C channel stud or horizontal PFRP brace

The PFRP C channel shape of the studs, 1, FIG. 3A, allows for a wider cavity to install approximately 20 percent (20%) more interior insulation within the wall assembly, 22, compared with using standard wood studs. Another advantage of the PFRP "C" channel frame assembly, 13, compared to traditional wood or metal framing is the ability to add a flexible epoxy bond (such as 3M Scotch-weld multi-material & composite urethane adhesive) between the PFRP "C" channel, 1, and PFRP sheathing, 4, to create a unibody structure impervious to air or water while increasing the strength of the structure by increasing sheer wall performance.

In addition to its lighter weight, which reduces the structural requirements of the foundation and building structure, using this specific system and method of assembly reduces construction time, equipment, and labor, thus, reducing the overall cost of construction and maintenance requirements over the lifetime of the structure.

Figure 2:
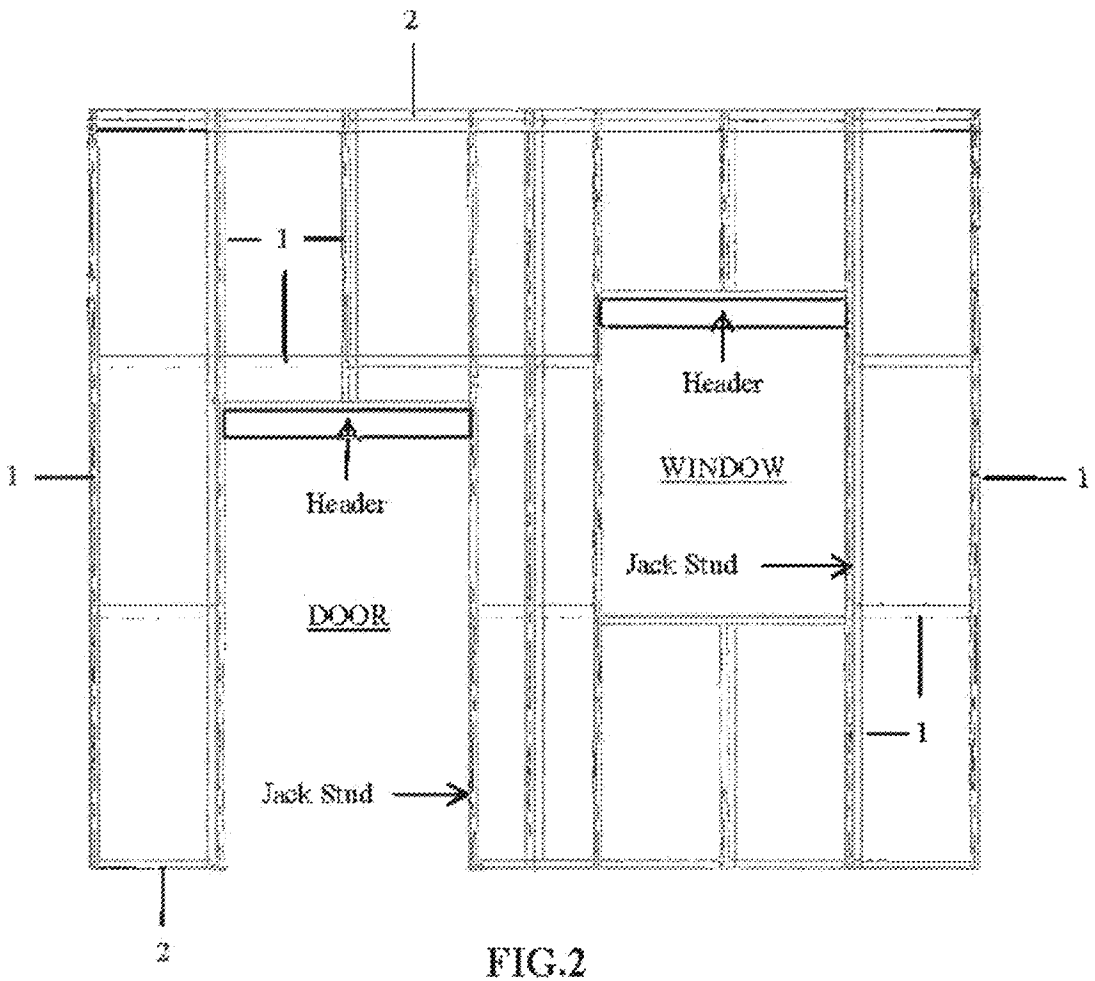
FIG. 2 is a schematic representation of a PFRP load bearing wall frame assembly

The PFRP frame assembly, 13, is versatile and can be used as a load-bearing wall, FIG. 2, system 100, by adding a PFRP header and a PFRP Jack-stud at window and door locations. Using a PFRP load bearing wall assembly, 22, can reduce the size of the foundation requirements on interior load bearing walls compared to traditional load bearing walls made of wood, steel, or concrete. A non-load bearing PFRP wall assembly, FIG. 1, system 100, can be constructed by removing the header and jack-stud at the window and door locations.

Current construction materials are subject to failure in the following areas: concrete cracks due to its rigidity and absorbs water or moisture; steel can bend, rust, or deform due to external forces, such as seismic activity, high-velocity winds, or intrusion of moisture; wood can rot or crack due to moisture and can be destroyed by insects. A PFRP frame assembly, 13, is resistant to all known failures related to current construction materials.

Figure 4:
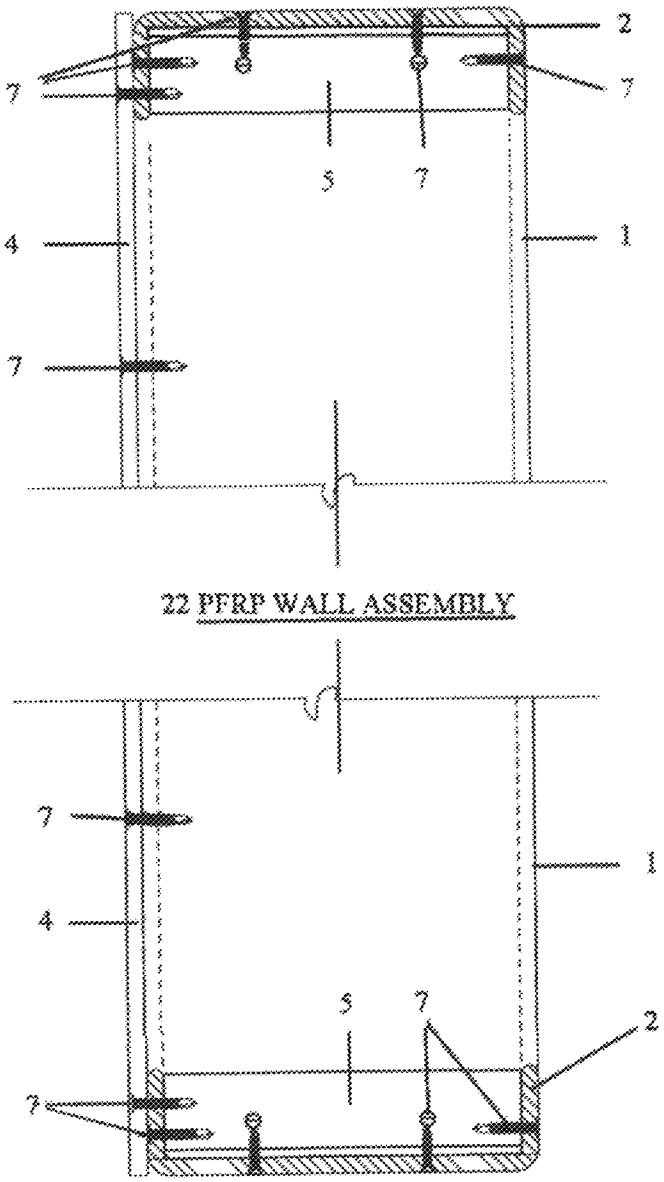
FIG. 4 is a schematic representation of the components and function of a PFRP wall frame assembly
Figure 5:
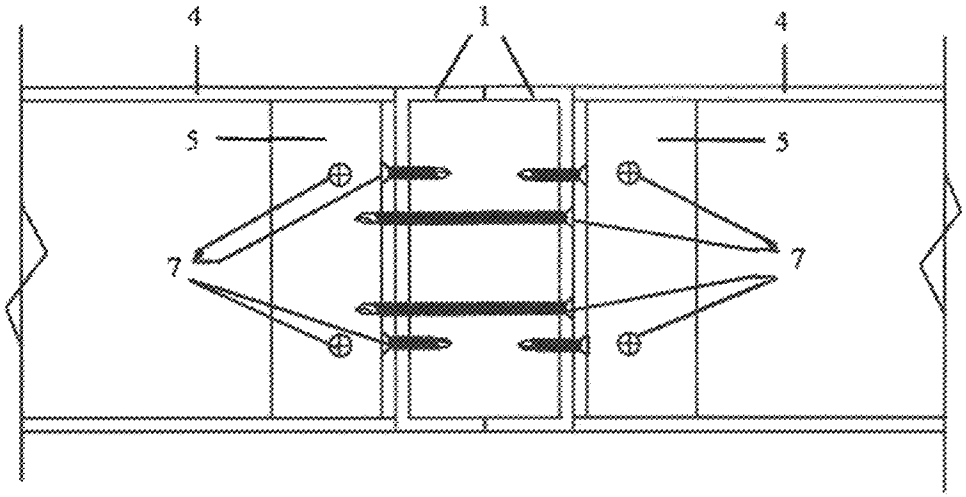
FIG. 5 is a schematic representation of the components and function of a vertical PFRP double C channel stud connected to horizontal PFRP C channel stud or PFRP C channel head or sill track at a window or door opening

The PFRP frame assembly, FIGS. 1 and 2, using PFRP framing components, FIG. 4, allows for a unified construction of the wall and which can reduce temperature differentials that cause expansion and contraction.

This PFRP advantage eliminates moisture, cracking and delaminating of the material layers while increasing the overall strength of the structure while using fewer materials compared to current construction standards.

The useful life or longevity of a traditional structure is limited by the natural occurring processes of degradation of current building materials. Any additional fluctuating ambient air temperature, moisture or water intrusion further compromises a traditional structure in less time, thereby, increasing maintenance costs and safety concerns. Using PFRP materials to construct the shell of a structure would eliminate all these known problems.

Describing further in detail of the PFRP framing assembly, 13, is the ability to attach a PFRP sheathing, such as non-ballistic or ballistic sheathing, 4, an architectural precast concrete cladding panel, 15, a tilt-wall concrete panel via a PFRP embed connector 11, 12, FIG. 10, or any traditional exterior cladding system. Furthermore, the PFRP wall system, 22, of system 1000, does not require an exterior weatherproof coating, between it or the exterior cladding system, 40, FIG. 21B, thus, allowing an architect flexible consideration for exterior designs and functionality. Currently, traditional exterior cladding systems must have an applied weatherproofing coating to prevent water intrusion.

The PFRP non-ballistic sheathing, 4, is constructed with standard pultrusion process whereas the PFRP ballistic sheathing, 4, is constructed using multi-directional glass fiber via a pultrusion process. The PFRP ballistic sheathing, 4, is designed to withstand high-velocity projectile impact by delaminating, thus, absorbing the energy associated with a high-velocity projectile.

The PFRP sheathing, 4, can be manufactured in varying thicknesses to protect persons or property within the structure from a wide range of high-velocity projectiles. This feature allows for construction within geographic areas prone to tornado, hurricane, or ballistic weapons.

PFRP products are made with a fire-retardant chemical, such as Bromine, contained within the resin. This process uses smoke produced by the fire-retardant chemical to extinguish the flame. This smoke is toxic and the PFRP material becomes combustible after the chemicals added to inhibit ignition have been overcome. Fire-retardant materials do not meet global fire regulations for non-combustible materials which are mandated for structural components within an occupied structure.

Figure 18:
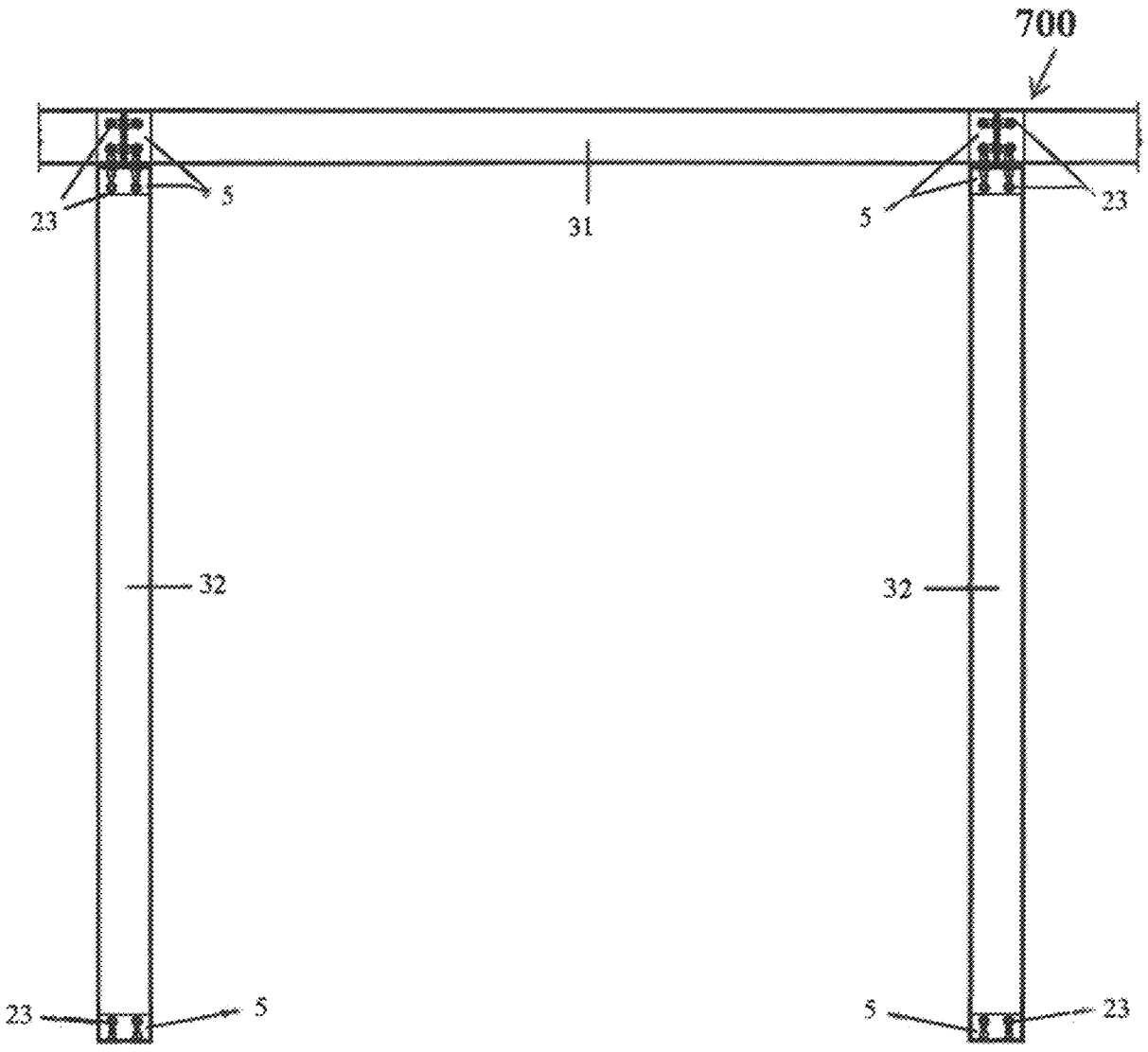
FIG. 18 is a schematic representation of the components and function of a horizontal PFRP I-beam or Wide Flange beam and vertical PFRP column structure

One advantageous feature of disclosed aspects is that PFRP structural components, such as PFRP wall sheathing, 4, PFRP wall assembly, 22 of system 100, PFRP floor and roof deck, 26 of system 400, vertical PFRP column, 32, and horizontal PFRP I-beam, 31, or PFRP horizontal wide flange beam, 31 of system 700, FIG. 18, intentionally do not contain the fire-retardant chemical, by request.

The disclosure relating to structural PFRP components, such as PFRP wall sheathing, 4, PFRP framing assembly, 13, and/or PFRP roof deck, 26, can employ an applied intumescent fire-barrier coating (such as Flame off Fire Barrier paint with a dried thickness of 17 mil). This coating can be applied to the PFRP wall sheathing, 4, PFRP wall assembly, 22, and/or roof deck, 26, during the manufacturing process, or otherwise prior to any finish coat or completion of a traditional interior or exterior finishing system. PFRP components coated with intumescent fire-barrier coating does not produce toxic smoke while inhibiting the ability of flames to crawl or grow larger, known as flame spread, and thus achieve ASTEM—E84, Class A Fire rating, ASTEM—E2768, Class A Fire rating with 30 minute extended, allowing for classification as a non-combustible material.

In some aspects, a thermal coating can be applied to the PFRP wall assembly, 22 of system 100 and PFRP floor and roof deck, 26 of system 300, to reduce heat gain from solar radiation.

The PFRP C channel studs, 1, FIG. 3A, can be arranged within the PFRP wall framing assembly, 13, in various configurations to better accommodate the structural integrity needed in both extreme cold and hot regions.

The PFRP frame assembly, 13 of system 100, can be shipped from an automated PFRP manufacturing facility to the job site with a plurality of PFRP embed connectors, 11 or 12, of system 200, FIG. 10, already installed on the PFRP frame assembly 13. A concrete cladding panel, 15, FIG. 10, is then poured at the job site. Once the concrete cures, the PFRP wall assembly, 22, can be lifted into position as a precast cladding system or tilted into position like a traditional tilt-up wall panel.

The PFRP embed connector, 12, FIG. 10, is designed with a pointed tip, 12, and a variable nut, 16, that holds the embed connector, 12, to the PFRP frame assembly, 13 while the fixed nut, 17, holds the PFRP frame assembly, 13, off the casting surface at the height needed to ensure uniform alignment of the exterior concrete face panel with the uniform alignment of the interior PFRP frame assembly, 13.

The PFRP embed connector, 11, is also designed with a flat tip, 11, and a variable nut, 16, and a fixed nut 17. The PFRP embed flat tip connector 11, used when an architectural reveal is designed into the concrete form. The PFRP flat tip embed connector, 11, is shorter than the PFRP pointed tip, 12, which allows the difference in concrete thickness to form a reveal in the concrete panel, thus, the PFRP flat tip embed connector, 11, provides the interior concrete spacing between the PFRP frame assembly and architectural reveal to accommodate the changing concrete thickness.

The PFRP embed connector, both pointed tip and flat tip, 11, 12, provides connection of the PFRP frame assembly, 13, to the concrete cladding, 15. This connection is made possible by PFRP embed connector shaft, 11, 12. The PFRP frame assembly, 13, combined with the PFRP embed connector, 11 or 12, which eliminates the need for an air gap, 14, and an insulation strip between the face of the PFRP frame assembly, 13, and the rear side of the concrete precast cladding, 15, FIG. 10, system 200.

Current art, U.S. Pat. No. 8,601,763, teaches using a ⅛" inch to 1" inch air gap with an insulation strip to minimize thermal bridging created by the steel frame and metal embed connector between the building structural frame and the precast cladding system. Thermal transfer is inherently present when using current building materials. The aspect of the disclosure teaches that an air gap and an insulation strip are no longer needed to minimize thermal bridging. Further disclosed aspect provides less than a ⅛" inch air gap including no gap which reduces the opportunity for water intrusion between the building structure and the concrete panel.

Figure 3B:
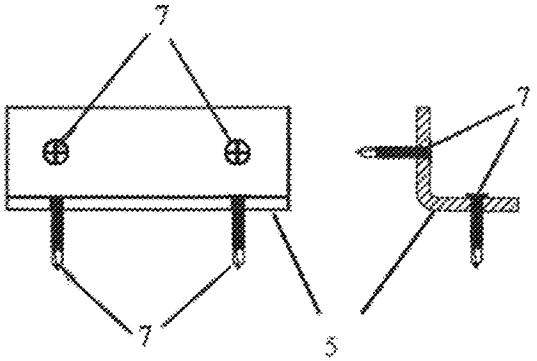
FIG. 3B is a schematic representation of a small PFRP clip angle bracket with attaching stainless steel screws
Figure 3C:
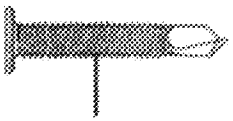
FIG. 3C is a schematic representation of a stainless steel self-tapping screw
Figure 3D:
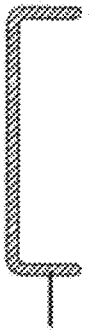
FIG. 3D is a schematic representation of a PFRP head or sill track
Figure 3E:
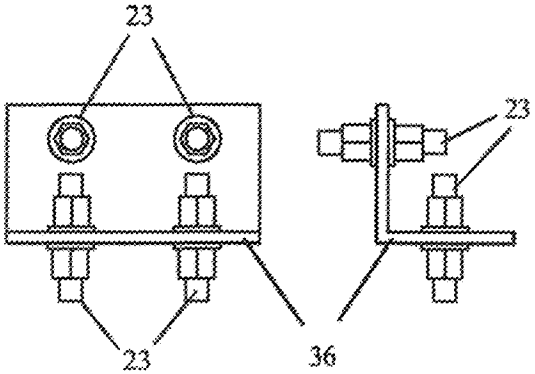
FIG. 3E is a schematic representation of a large clip angle bracket with attaching steel bolts
Figure 3F:
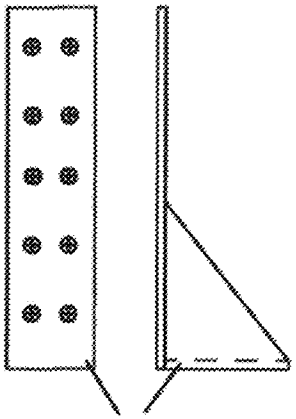
FIG. 3F is a schematic representation of a metal hold-down bracket
Figure 11:
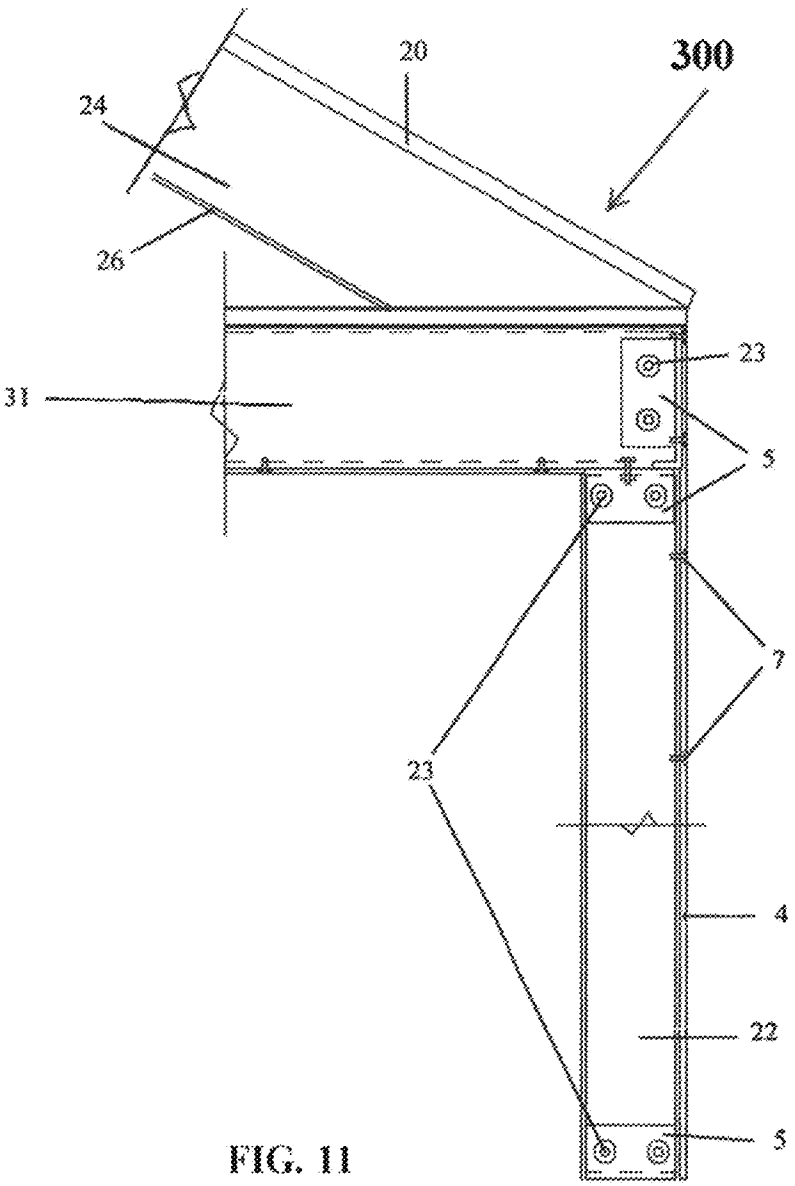
FIG. 11 is a schematic representation of the components and function of a PFRP roof types (flat and pitched) to a PFRP wall frame assembly

The PFRP frame assembly, 13 of system 100, contains a vertical PFRP column, 32, and horizontal PFRP I-beam, 31, or wide flange horizontal beam, 31 of system 700, FIG. 18, which connects to a PFRP roof assembly, system 300, FIG. 11, by using a PFRP clip angle bracket, 5 of FIG. 3B and FIG. 11.

Figure 15:
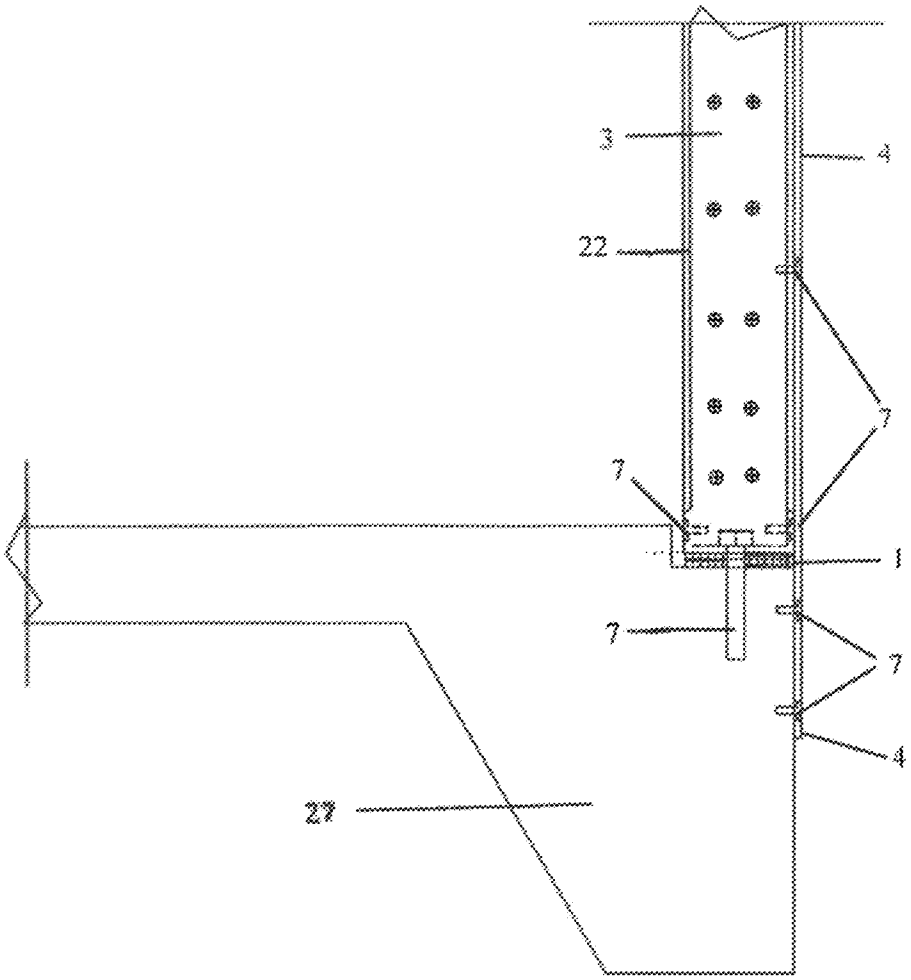
FIG. 15 is a schematic representation of the components and function of a PFRP wall assembly connected to a traditional concrete footing
Figure 16:
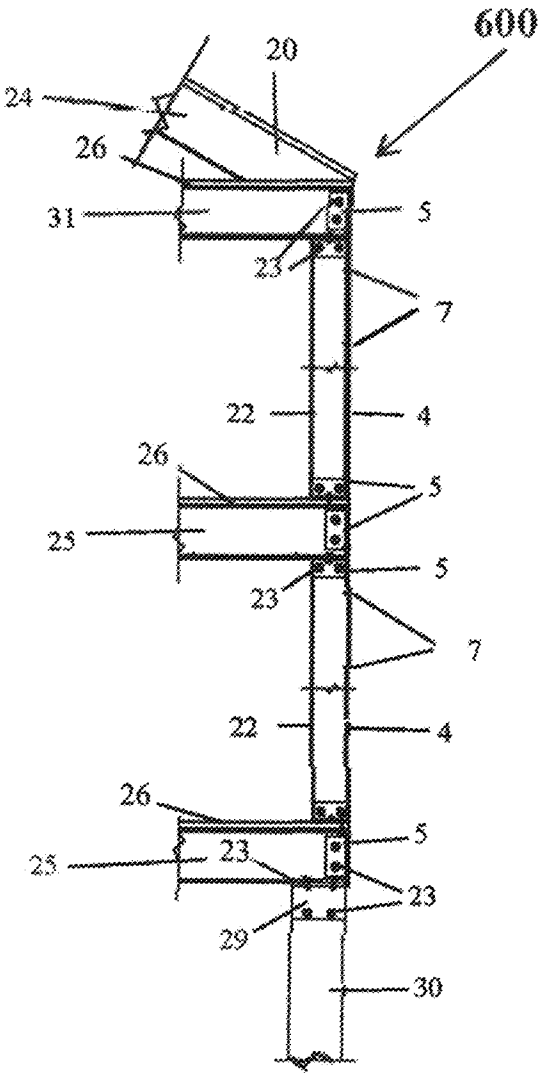
FIG. 16 is a schematic representation of the components and function of a PFRP roof, wall and floor assembly for a multi-story structure connected to a PFRP piling with a PFRP flange

The PFRP column, 32, and the PFRP beam, 31, provides the structural support of the PFRP roof assembly system 300 in FIG. 11, and transfers the PFRP roof load to a concrete foundation, 27 of FIG. 14 and system 500, or PFRP piling, 30, FIG. 16 of system 600. The PFRP non-ballistic or ballistic sheathing, 4, overlaps the PFRP column, 32, and PFRP roof assembly, system 300 of FIG. 11 to provide continuous coverage on the exterior side of the structure to prevent water, moisture and air intrusion, FIGS. 14 and 15. The PFRP roof assembly, system 300 of FIG. 11, uses the PFRP structural frame, system 700 of FIG. 18, to support a PFRP roof deck, 20 or 21 of system 300, FIG. 11.

Figure 19A:
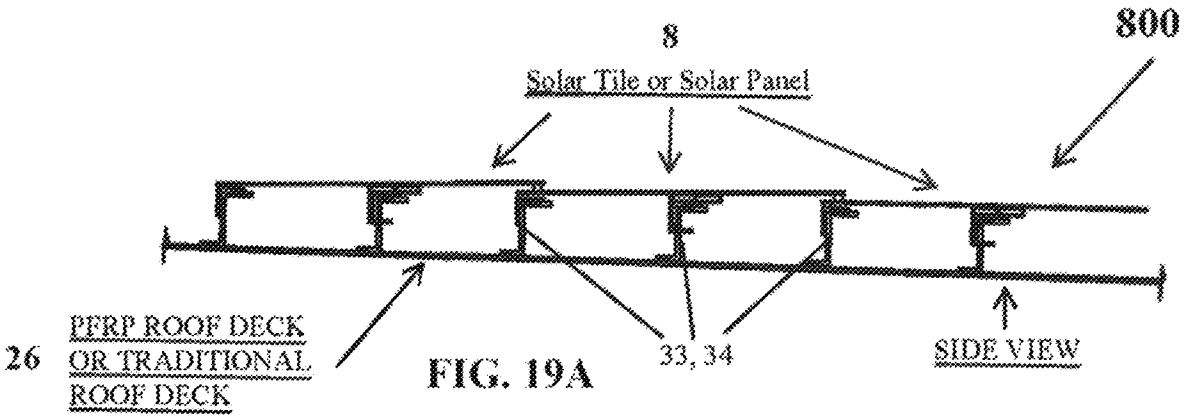
FIG. 19A is a schematic representation of the components and function of a solar roof tile or solar roof panel with a PFRP mounting bracket and PFRP Z bracket connected to a roof deck, side view
Figure 19B:
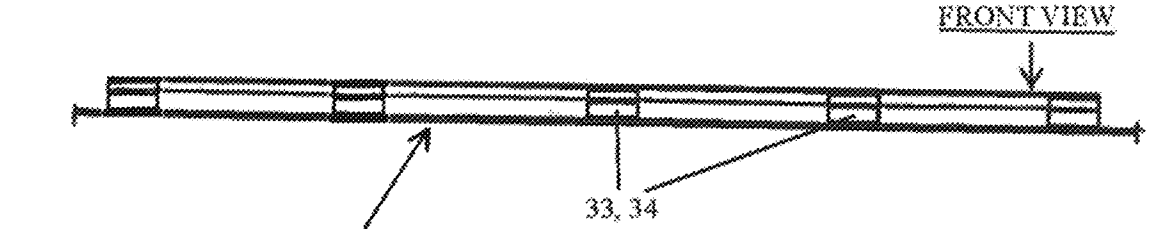
FIG. 19B is a schematic representation of the components and function of a solar roof tile or solar roof panel with a PFRP mounting bracket and PFRP Z bracket connected to a roof deck, front view
Figure 19C:
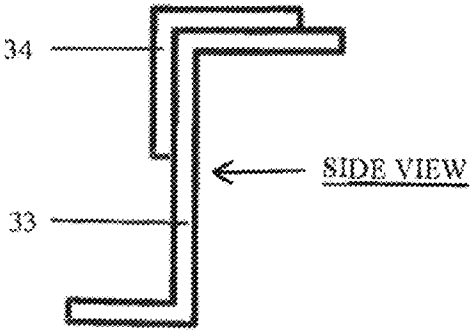
FIG. 19C is a schematic representation of the components and function of a PFRP Z bracket with an attached solar tile or solar panel using a PFRP mounting bracket, side view
Figure 20A:
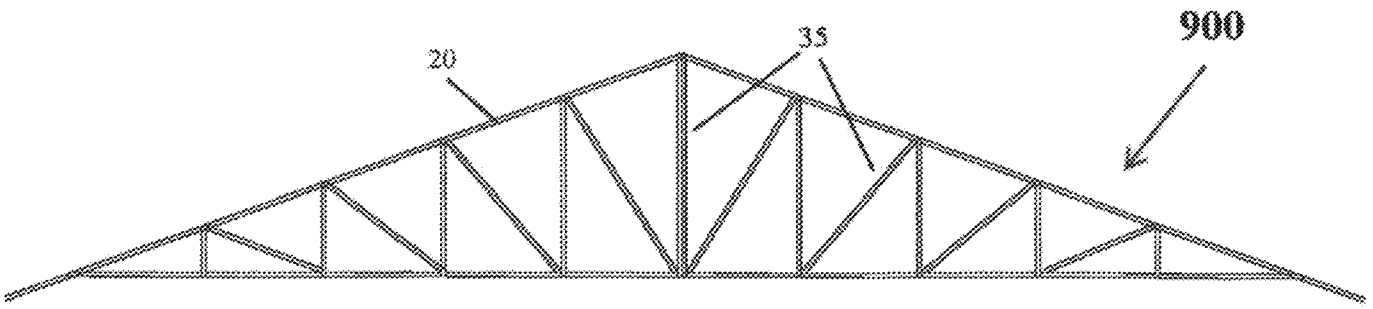
FIG. 20A is a schematic representation of the components and function of a HIPP or GABLE roof using any combination of PFRP C channel, L channel or hollow tubes for trusses or joists
Figure 20B:
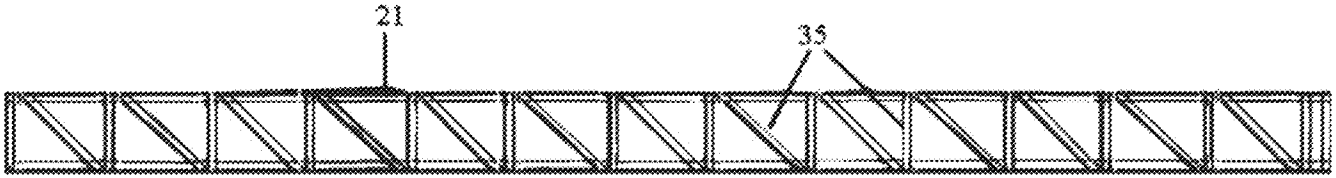
FIG. 20B is a schematic representation of the components and function of a flat roof using any combination of PFRP C channel, L channel or hollow tubes as trusses or joists
Figure 20C:
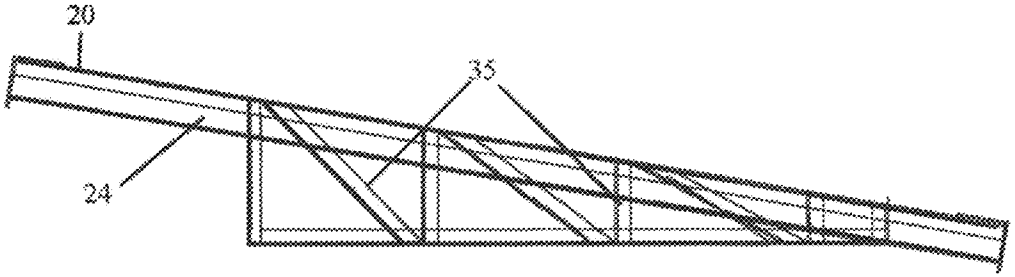
FIG. 20C is a schematic representation of the components and function of a high-pitched or slant roof using any combination of PFRP C channel, L channel or hollow tubes as trusses or joists

The PFRP roof assembly, system 300 of FIG. 11, can be either a PFRP flat pitch roof, 21, or an PFRP pitched roof, 20, FIGS. 20A, 20B, & 20C. Either PFRP roof assembly, system 300, can support a solar panel or solar roof tile, system 800 of FIG. 19A, using the PFRP solar mounting brackets, 33 and 34 of FIG. 19C.

One advantage of using the PFRP solar mounting bracket, 33 and 34, is to elevate the solar roof panel or the solar roof tile a minimum of 3¾" inches off the roof, FIG. 19A, thus, allowing ambient air flow to occur under the solar panel or tile.

This design reduces the thermal loading of the solar panel or solar roof tile, system 800, and can increase the solar power generation efficiency approximately 35% per solar panel or solar tile.

Figure 12:
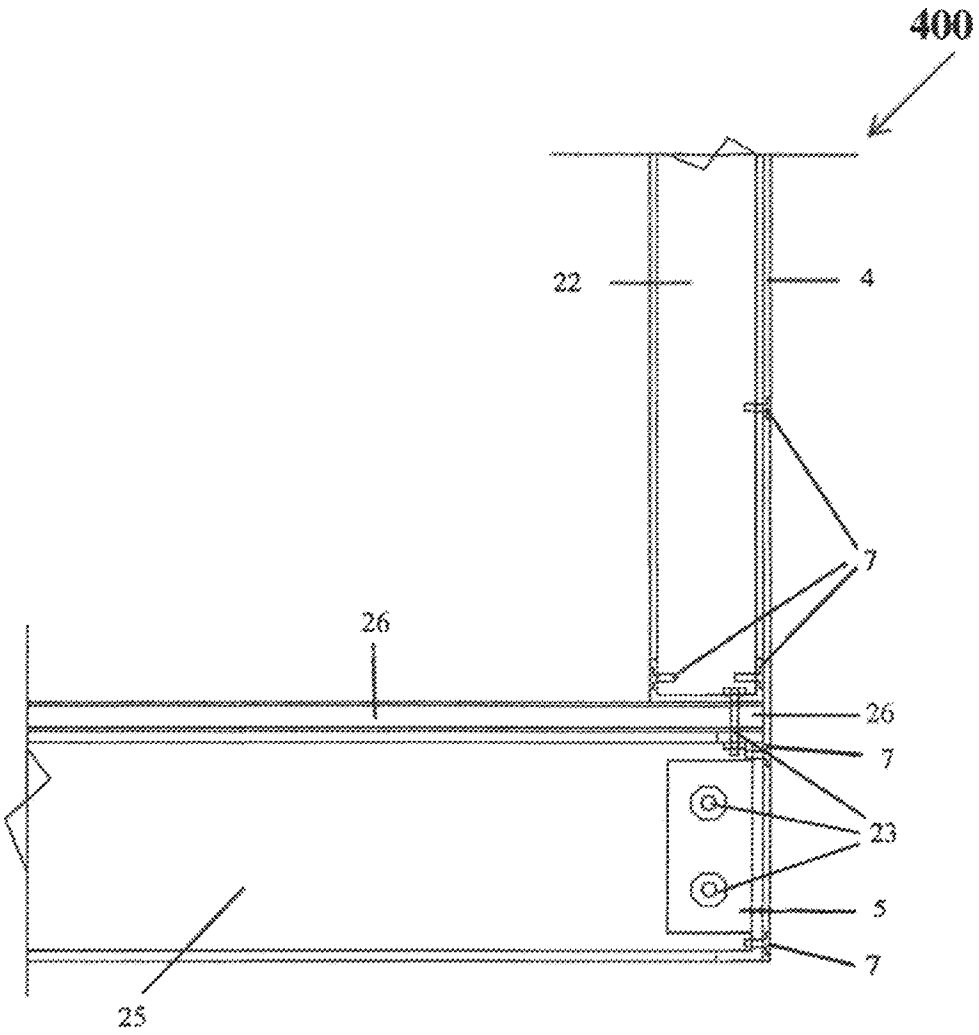
FIG. 12 is a schematic representation of the components and function of a PFRP wall assembly connection to a PFRP floor assembly
Figure 13:
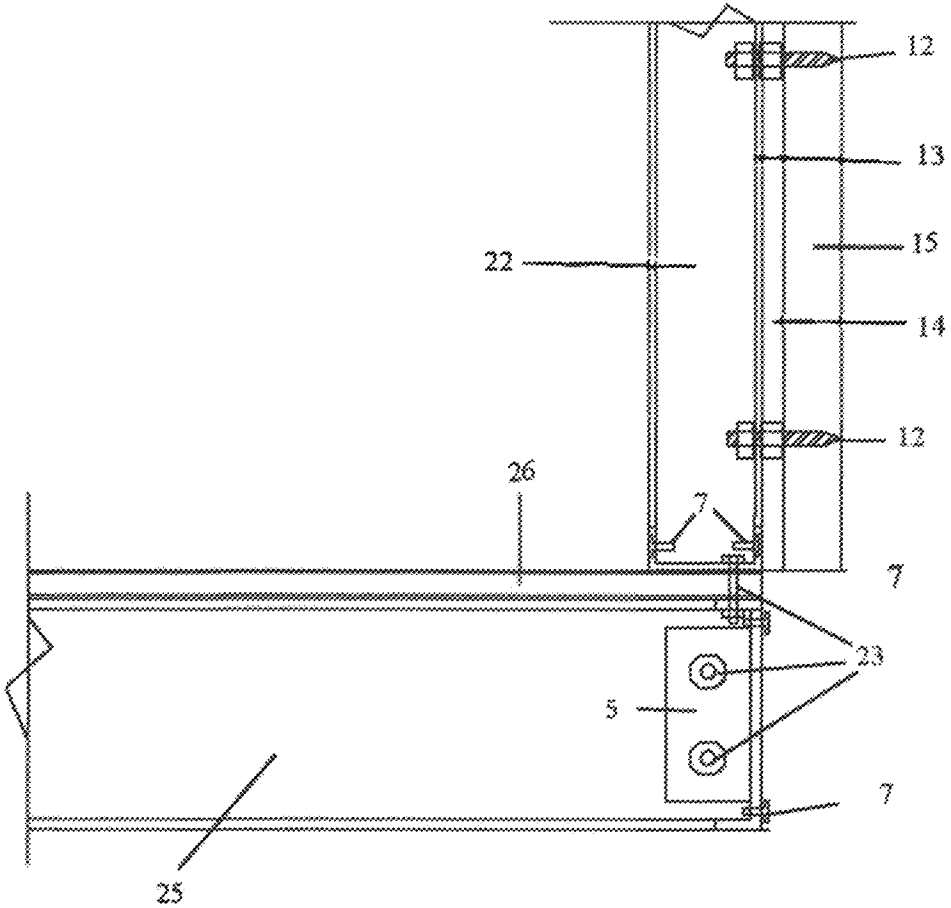
FIG. 13 is a schematic representation of the components and function of a PFRP frame assembly with an exterior architectural concrete cladding to a PFRP floor assembly

The PFRP wall assembly, 22, contains a PFRP column, 32, which connects to a PFRP floor assembly, 25 of FIG. 12, by using a PFRP clip angle bracket, 5. The PFRP column, 32, provides the structural support of the roof, transferring the roof load to the horizontal PFRP beam, 31, and PFRP column, 32, to the concrete foundation, 27, or PFRP piling, 30, FIGS. 16 and 17. The PFRP non-ballistic or ballistic sheathing, 4, overlaps the PFRP column, 32, and PFRP floor assembly, 25, to provide continuous coverage on the exterior side to prevent water, moisture and air intrusion, FIGS. 14 and 15.

Figure 17:
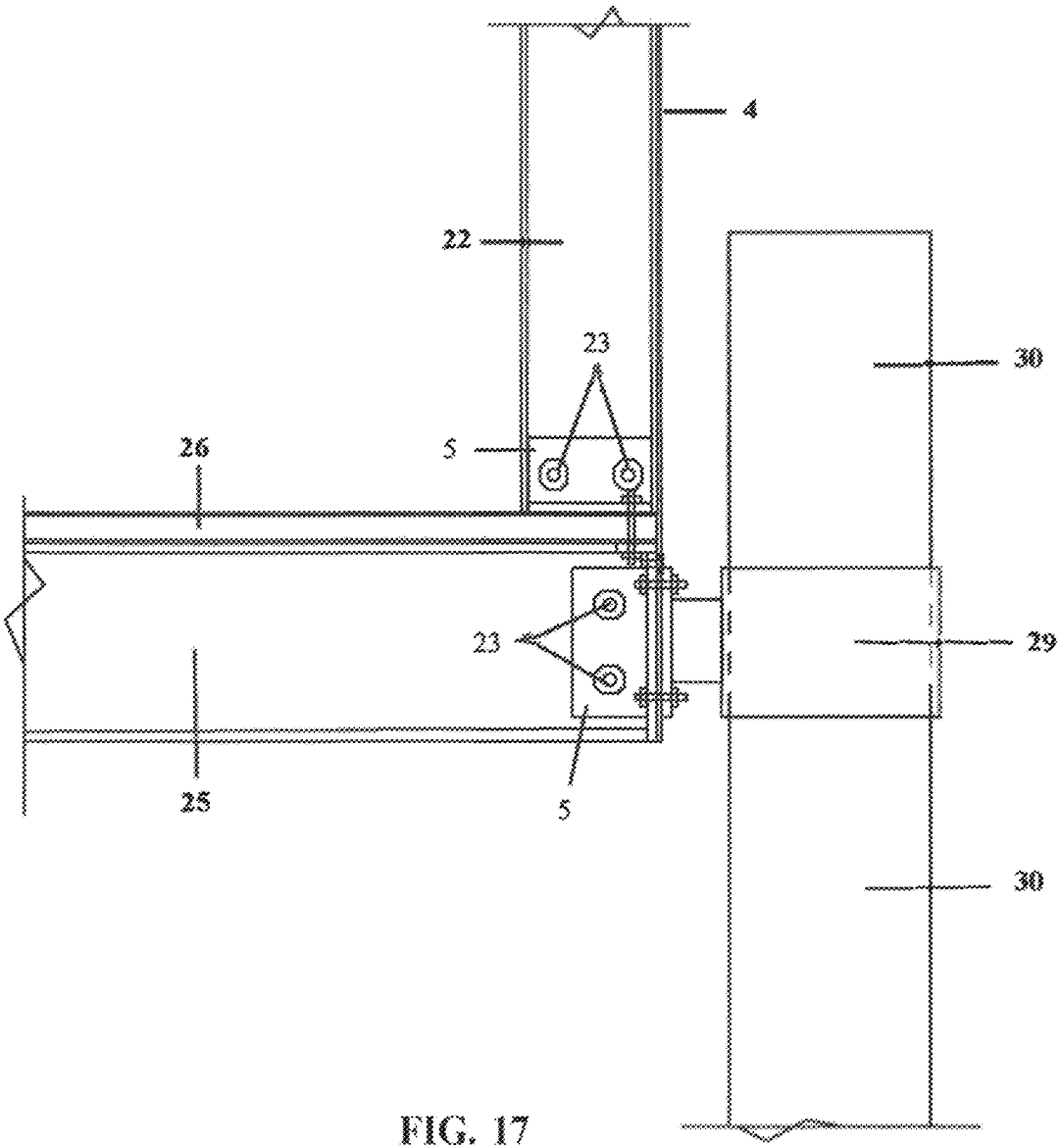
FIG. 17 is a schematic representation of the components and function of a PFRP wall and floor assembly connected to a PFRP piling with a PFRP flange

This method is repeated for a multi-story structure, FIGS. 14 and 16, which transfers the entire structural load to the concrete foundation, 27 of FIG. 15, or PFRP piling, 30 of FIGS. 16 and 17. The PFRP non-ballistic or ballistic sheathing, 4, overlaps the PFRP column, 32, and PFRP floor assembly, 25, to provide continuous coverage on the exterior side of the structure to prevent water, moisture and air penetration, FIG. 15.

The PFRP floor assembly, 25, can connect to a PFRP pilling, 30, to elevate the structure off the ground, FIGS. 16 and 17. The PFRP pilling, 30, contains a PFRP flange, 29 of FIG. 17, which uses a PFRP bolt or metal bolt and flexible epoxy to connect the PFRP floor assembly to the PFRP flange, FIG. 17. In addition, flexible epoxy is applied between the PFRP flange, 29, and PFRP piling, 30, and PFRP floor assembly, 25, to form a flexible bond which is waterproof.

The PFRP structural assembly, FIG. 1, system 100, consists of a vertical PFRP I-beam, 32, or PFRP wide flange column, 32, and an PFRP I-beam, 31, or horizontal PFRP wide flange beam, 31, which are connected via a PFRP clip angle bracket, 5, and PFRP bolts or traditional bolts. The PFRP I-beam, 32, or PFRP wide flange columns, 32, are connected to a PFRP floor assembly, 25, via a PFRP clip angle bracket, 5, into a concrete foundation, 27, via a metal concrete anchor or connected to an PFRP floor assembly, 25, using PFRP bolts or metal bolts.

This PFRP frame assembly, 13, system 100, is stronger, on a pound for pound comparison to steel. This allows versatility in many different configurations to construct a residential, commercial, or mobile structure without any modification to the PFRP frame assembly, 13, system 100. In a PFRP mobile configuration the PFRP frame, system 700, is engineered in strength to be configured to accommodate a fixed wheel assembly or temporary wheel assembly, making the structure a trailer by connecting it to the back of a vehicle or remove the wheel assembly so that the structure can be mounted on the back of a truck as a "box unit", or place "D" rings on all exterior corners to provide lifting points to support aerial, sling-load, transportation by a helicopter. In addition, heavy duty swivel casters can be mounted along the bottom of the PFRP frame assembly, 13, system 100, such as to allow the structure to be manually moved over a smooth surface.

Using the PFRP frame assembly, 13, components connect the PFRP non-ballistic or PFRP ballistic sheathing, 4, to the PFRP frame assembly, 13, using stainless steel, self-drilling screws, 7 and a flexible epoxy which bonds the PFRP non-ballistic or PFRP ballistic sheathing, 4, to the PFRP frame assembly, 13, creating a one-piece (unibody) composite wall assembly, 22, which increases the wall panel strength by reducing deflection and increasing sheer wall performance, while preventing water, moisture, or air intrusion. This assembly method would also apply to connecting a PFRP frame assembly, 13, system 200, to an architectural precast concrete cladding, tilt wall exterior wall covering or PFRP cladding for mid-rise and high-rise structures.

When connecting system 100 to system 600, the PFRP pilings, 30, are installed first. The PFRP floor assembly, 25 of system 400, is then connected to the PFRP pilings, 30 of system 600, via the PFRP flange, 29. System 100 is then erected and connected to the PFRP floor assembly, 25 of system 400.

In other configurations, the PFRP floor system, 25 of system 400, can contain a PFRP flange, 29, mounted to the outside of the PFRP floor frame, 25, and on each corner.

A PFRP piling, 30, FIG. 17, can then be inserted into the PFRP flange, 29, allowing the PFRP structure to move freely up and down the PFRP piling, 30. This configuration would be practicable for a floating PFRP structure when applying foam or other buoyant materials within or under the PFRP floor assembly, 25, to allow the PFRP structure to float on water. The combination of the exterior mounted PFRP flange, 29, FIG. 17, sliding freely along the PFRP piling, 30, would allow the floating PFRP structure to naturally adjust its height during tidal changes or changing water volumes/elevations. Such aspects can eliminate the need to add waterproofing to the structure.

When constructing a PFRP mobile structure, the horizontal PFRP I-beam or wide flange beam, 31, System 700, is first connected to the PFRP floor assembly, 25 of system 400. System 100 is then attached to the PFRP floor assembly, 25, and then system 300 is connected to system 100 to complete a complete PFRP mobile structure. A wheel assembly can be mounted to system 700.

Additional configurations allow a wheel assembly, or without a wheel assembly, the frame assembly of system 700 to accommodate attachment points on the horizontal PFRP I-beam or wide flange beam, 31, using a traditional heavy-duty "D" ring that will allow the mobile unit to be picked up by a crane or airlifted by a helicopter for transport. This mobile structure is similar in size but not in weight to a standard metal Conex container or can be constructed without the PFRP walls or PFRP roof to allow for design as an open trailer.

In the above listed roof configurations, the PFRP roof assembly, system 300, attaching to the PFRP frame assembly, 13 of system 100 can accommodate a solar power system, system 800, by using PFRP solar panel or solar tile, FIG. 19A, when using the PFRP solar mounting method of FIG. 19C, of system 800.

The lightweight advantage and ease of construction for the entire PFRP structure can allow a manufacturing facility to assemble the PFRP components for shipment via truck, rail, ship, or aircraft as a modular unit or "Flat Packed" for easy shipment to other locations for final assembly to be a fixed or mobile structure.

Current and long-standing building methods use a variety of building materials (concrete, steel, wood). Each of these materials has their own set of thermal conductive properties which absorb and dissipate temperature at variable rates over time. This variance in temperature between the materials can require design and engineering attention to solve for the results of thermal loading on a structure. Further, some materials are known to retain heat longer than others, requiring larger climate control systems, in addition to creating condensation or excess moisture within the walls of the building structure. This can lead to mold, algae, cracking, warping or corrosion. Disclosed aspect that uses PFRP for all building components solves these and other problems. An all-PFRP structure can have components that expand and contract at the same time, thereby, making the entire structure more structurally sound and more energy efficient.

Some aspects provide for systems and methods that use PFRP components combined with a flexible epoxy, which can allow the PFRP structure to function as a unibody structure which is impervious to air or water and provides a uniform coefficient of thermal expansion throughout the shell of the structure. Current construction materials and methods do not teach nor provide these features.

The previous description is provided to enable a person skilled in the art to make or use the disclosure. Various modifications to the disclosure will be readily apparent to those skilled in the art, and the common principles defined herein may be applied to other variations without departing from the spirit or scope of the disclosure.

Furthermore, although elements of the described aspects and/or embodiments may be described or claimed in the singular, the plural is contemplated unless limitation to the singular is explicitly stated.

Additionally, all or a portion of any aspect and/or embodiment may be utilized with all or a portion of any other aspect and/or embodiment, unless stated otherwise. Thus, the disclosure is not to be limited to the examples and designs described herein but is to be accorded the widest scope consistent with the principles and novel features disclosed herein.

The invention claimed is:

1. A pultrusion fiber reinforced polymer (PFRP) roof assembly, comprising:

a plurality of PFRP trusses or joists, comprising at least one horizontal PFRP C channel, or L channel, or hollow tube configured to be connected to at least one horizontal PFRP I-beam or at least one horizontal PFRP wide flange beam; and at least one PFRP clip angle bracket that connects the plurality of PFRP trusses or joists to configure the PFRP assembly to support PFRP sheathing;

wherein the PFRP assembly employs a flexible epoxy configured to provide a uniform coefficient of thermal expansion throughout the PFRP assembly.

2. The PFRP assembly of claim 1, wherein the PFRP sheathing comprises PFRP ballistic sheathing or PFRP non-ballistic sheathing or PFRP hollow core plank or PFRP solid core plank.

3. The PFRP assembly of claim 1, wherein the PFRP sheathing is connected to the plurality of PFRP trusses or joists using stainless steel screws or bolts.

4. The PFRP assembly of claim 1, further comprising stainless steel screws or a flexible epoxy that bonds PFRP sheathing to the plurality of PFRP trusses, horizontal I-beam, or horizontal wide flange beam.

5. The PFRP assembly of claim 1, further comprising an intumescent fire-resistant coating applied to interior and exterior surfaces of the PFRP assembly or sheathing attached to the plurality of PFRP trusses or joists, to produce an insulating barrier when exposed to heat.

6. The PFRP assembly of claim 1, wherein a set of PFRP clip angle brackets, stainless steel self-drilling screws or bolts configure the plurality of PFRP trusses or joists to be connected to the at least one horizontal PFRP I-beam or at least one horizontal PFRP wide flange beam.

7. The PFRP assembly of claim 1, wherein the plurality of PFRP trusses or joists are configured to be connected to a PFRP horizontal beam or a PFRP column of a PFRP wall panel assembly.

8. The PFRP assembly of claim 7, wherein the PFRP column is configured to transfer roof load to a concrete foundation or PFRP piling.

9. The PFRP assembly of claim 1, wherein the assembly is a roof assembly and the plurality of PFRP trusses or joists are configured to provide for a flat-pitch roof or a pitched roof.

10. A pultrusion fiber reinforced polymer (PFRP) structural building assembly, comprising:

a PFRP floor assembly, comprising a top surface of PFRP ballistic or non-ballistic sheathing or PFRP hollow core plank or PFRP solid core plank, a bottom surface of PFRP ballistic or non-ballistic sheathing or PFRP hollow core plank or PFRP solid core plank, and at least one side surface of PFRP ballistic or non-ballistic sheathing or PFRP hollow core plank or PFRP solid core plank, surrounding the top surface and the bottom surface to comprise a fully enclosed hollow PFRP floor assembly; and at least one PFRP flange connected to the at least one side surface of the PFRP floor assembly and extending in an outward direction from the PFRP floor assembly, the PFRP flange configured to encircle a vertical PFRP piling and move axially along the vertical PFRP piling, wherein the PFRP floor assembly employs a flexible epoxy configured to provide a uniform coefficient of thermal expansion throughout the PFRP floor assembly.

* * * * *